US008251743B2

(12) United States Patent
Sakamoto et al.

(10) Patent No.: US 8,251,743 B2
(45) Date of Patent: Aug. 28, 2012

(54) CONNECTOR

(75) Inventors: Nobuyuki Sakamoto, Makinohara (JP); Youji Kutsuna, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/089,728

(22) Filed: Apr. 19, 2011

(65) Prior Publication Data

US 2011/0256752 A1 Oct. 20, 2011

(30) Foreign Application Priority Data

Apr. 20, 2010 (JP) ..... 2010-097357

(51) Int. Cl.
*H01R 13/40* (2006.01)

(52) U.S. Cl. ..... 439/595

(58) Field of Classification Search ..... 439/370, 439/595, 752, 352, 468, 345
See application file for complete search history.

(56) References Cited

U.S. PATENT DOCUMENTS 5,651,700 A * 7/1997 Sato et al. ..... 439/595
5,979,047 A * 11/1999 Gib ..... 29/883
6,589,079 B2 * 7/2003 Kashiyama et al. ..... 439/595
7,208,329 B2 * 4/2007 Fukatsu et al. ..... 438/14
7,419,395 B2 * 9/2008 Tsuji et al. ..... 439/271
7,419,409 B2 * 9/2008 Machida et al. ..... 439/852
7,661,999 B2 * 2/2010 Horiuchi et al. ..... 439/752
8,137,123 B2 * 3/2012 Sakamoto ..... 439/345
2004/0253882 A1 * 12/2004 Fukatsu et al. ..... 439/752
2011/0256752 A1 * 10/2011 Sakamoto et al. ..... 439/370

FOREIGN PATENT DOCUMENTS

JP 2008-65985 A 3/2008

* cited by examiner

*Primary Examiner* — Alexander Gilman
(74) *Attorney, Agent, or Firm* — Sughrue Mion, PLLC

(57) ABSTRACT

Terminal insert holes 61 are provided in a spacer 60 inserted into an inner housing. In each of the terminal insert holes 61, a lance 62 is provided. The lance is arranged in an obliquely upper position relative to the vertical direction and the transverse direction seen from a central part of the terminal insert hole 61. A bending direction of each lance is set to a direction substantially corresponding to the oblique direction. Further, in the spacer 60, an engaging protrusion part 63 is provided as a mainly terminal engaging part. Thus, the spacer is pushed in to a mainly engaged position from a temporarily engaged position to shift a temporary engagement by the lance to a main engagement by the engaging protrusion part.

6 Claims, 22 Drawing Sheets

DURING SECONDARY ENGAGEMENT

DURING PRIMARY ENGAGEMENT

CONNECTOR

BACKGROUND OF THE INVENTION

1. Field of the Invention

The present invention relates to a connector that prevents a terminal inserted into a terminal insert hole from a rear part from slipping out by a flexible lance provided so as to face an inner space of the terminal insert hole.

2. Description of the Related Art

An ordinary connector used for a vehicle includes a flexible lance so as to face each of terminal insert holes of a connector housing and uses a bending of the lance to prevent a terminal inserted into the terminal insert hole from a rear part from slipping out. In the connector of this kind, the lances are ordinarily provided rightward and leftward (a transverse direction) or upward and downward (a vertical direction) of the connector housing as a direction of an arrangement of the plurality of terminal insert holes whether or not the lances are provided integrally with or separately from the connector housing (for instance, see patent literature 1).

Recently, a request for a miniaturization of the connector and a request for a multi-polar form of the connector are increased. In order to meet the request for the miniaturization or the multi-polar form, distances between a plurality of terminals need to be reduced.

Patent literature 1: JP-A-2008-65985

However, in the above-described usual connector, since the lances that prevent the terminals from slipping out are provided rightward and leftward (the transverse direction) or upward and downward (the vertical direction) of the connector housing as the direction of an arrangement of the terminal insert holes, when the bending spaces of the lances are considered, the reduction of pitches between the terminals is limited. Thus, many terminals cannot be densely arranged.

SUMMARY OF THE INVENTION

The present invention is devised by considering the above-described circumstances, and it is an object of the present invention to provide a connector that makes it possible to more densely arrange terminals and to easily meet a request for a miniaturized connector or a multi-polar connector.

In order to solve the above-described problems, a connector of the invention defined in a first aspect of the invention includes a connector housing having many terminal insert holes extending forward and backward which are arranged in the vertical direction and in the transverse direction; and a plurality of terminals respectively inserted into the terminal insert holes of the connector housing from a rear part, flexible lances being provided respectively in the terminal insert holes of the connector housing to prevent the terminals from slipping out rearward when the terminals are inserted into the terminal insert holes from the rear part, and is characterized in that the lance is arranged at a position in an oblique direction relative to the vertical direction and the transverse direction seen from a central part of each of the terminal insert holes and a bending direction of the lance is set to a direction substantially corresponding to the oblique direction.

A connector defined in a second aspect of the invention is characterized, in the connector according to the first aspect of the invention, in that when the arrangement of the terminal insert holes in the transverse direction is referred to as a line, the terminal insert holes are arranged with pitches fixed between the lines in the vertical direction and linearly arranged with the fixed pitches in the transverse direction in each of the lines in the vertical direction, and between the adjacent lines in the vertical direction, positions of the terminal insert holes are shifted by 1/integer times as long as the arrangement pitch in the transverse direction.

A connector defined in a third aspect of the invention is characterized, in the connector according to the first aspect of the invention, in that the connector housing includes a spacer insert recessed part formed from an outer peripheral surface of the connector housing to an inner part and a spacer that can be inserted into the spacer insert recessed part in a direction intersecting an inserting direction of the terminal, has a temporarily engaging unit which is temporarily engaged with the connector housing under an inserted state and a mainly engaging unit which is mainly engaged with the connector housing, has terminal insert holes corresponding to the terminal insert holes of the connector housing and has a mainly terminal engaging part which permits the terminal to be inserted into the terminal insert hole at a temporarily engaged position and is mainly engaged with the terminal at a mainly engaged position to prevent the terminal from moving forward and backward, and, in the spacer, the lance is integrally provided as a temporarily terminal engaging unit that is temporarily engaged with the terminal when the terminal is inserted into the terminal insert hole from the rear part under a state that the spacer is located in the temporarily engaged position.

A connector defined in a fourth aspect of the invention is characterized, in the connector according to the third aspect of the invention, in that an inserting direction of the spacer to the spacer insert recessed part is set to a direction extending upward from a lower surface of the connector housing, the temporarily engaged position is set to a lower position where the insertion of the spacer to the spacer insert recessed part is shallow and the mainly engaged position is set to an upper position where an insertion to the spacer insert recessed part is deep, the mainly terminal engaging part is provided, in an inner bottom part of the terminal insert hole of the spacer, as an engaging protrusion part fitted to an engaging recessed part of the terminal side, an engaging edge part of the engaging protrusion part is provided as an edge part substantially parallel to the transverse direction, the lance is arranged at an obliquely upper position of the terminal insert hole of the spacer and an engaging edge part of the lance fitted to the engaging recessed part of the terminal side is provided as an edge part orthogonal to the bending direction of the lance.

A connector defined in a fifth aspect of the invention is characterized, in the connector according to the fourth aspect of the invention, in that the terminal insert holes of the connector housing are formed as circular holes, the terminal is formed as a round terminal having a cylindrical box part for receiving a male terminal of a mate connector, in a rear part of the box part of the round terminal, an engaging part is provided that is engaged with the lance and the engaging protrusion part and positions a rotating direction of the round terminal during a process of engagement, in a further rear side, an electric wire connecting part is provided to which a terminal of a coated electric wire is connected, the engaging part includes an engaging recessed part formed by recessing two opposed surfaces of a cylindrical periphery wall forming the box part and a rotating direction position control part formed by the cylindrical periphery wall remaining at a position where the engaging recessed part is formed, the engaging recessed part is provided to which the engaging edge part of the lance and the engaging edge part of the engaging protrusion part of the spacer are fitted to prevent the terminal from moving forward and backward, and the rotating direction position control part is provided to apply a rotation for controlling a position in a rotating direction to the terminal by a rotation moment generated by a contact pressure when the engaging edge part of the lance and the engaging edge part of the engaging protrusion part of the spacer are pressed to come into contact therewith.

A connector defined in a sixth aspect of the invention is characterized, in the connector according to the fifth aspect of the invention, in that an angle formed by the engaging edge part of the engaging protrusion part and the engaging edge part of the lance is set to a range of 30° to 60°.

According to the invention defined in the first aspect of the invention, since the lance is arranged at the position in the oblique direction relative to the vertical direction and the transverse direction (the directions in which the terminal insert holes are arranged) seen from the central part of each of the terminal insert holes and the bending direction of the lance is set to the direction substantially corresponding to the oblique direction, the blank spaces between the plurality of terminal insert holes are effectively used so that the lances may be arranged or the bending spaces of the lances may be ensured. Accordingly, the terminals can be densely arranged, which can contribute to the miniaturization or the multi-polar form of the connector.

According to the invention defined in the first aspect of the invention, since the positions of the terminal insert holes in the transverse direction are shifted between the adjacent upper and lower lines, the blank spaces between the terminal insert holes are effectively used and many terminal insert holes can be densely arranged in the vertical direction. Accordingly, the terminals can be more densely arranged, so that the connector can be more miniaturized or the connector can have a more multi-polar form. Further, since an amount of shift of the terminal insert holes in the transverse direction between the adjacent upper and lower lines is set to 1/integer times as long as the pitch between the terminals in the transverse direction, the positions of the terminal insert holes can be allowed to mutually correspond in the transverse direction between the lines spaced by lines of an inverse number of 1/integer. For instance, when the positions of the terminal insert holes in the transverse direction are shifted by ½ times as long as the arrangement pitch between the adjacent upper and lower lines, the positions of the terminal insert holes can be allowed to mutually correspond in the transverse direction on every other line in the vertical direction. Further, when the positions of the terminal insert holes in the transverse direction are shifted by ⅓ times as long as the arrangement pitch between the adjacent upper and lower lines, the positions of the terminal insert holes can be allowed to mutually correspond in the transverse direction at intervals of two lines in the vertical direction. Accordingly, a prescribed regularity can be provided irrespective of a zigzag arrangement.

Further, according to the invention defined in the third aspect of the invention, since the spacer that is mainly engaged with the inserted terminal is provided integrally with the lances as the temporarily terminal engaging units, under a state that the individual terminals are respectively temporarily engaged with the lances, the spacer is inserted to the mainly engaged position, so that all the terminals can be mainly engaged with the mainly terminal engaging parts provided in the spacer at the same time. Accordingly, assembly workability is improved and the terminals can be assuredly fixed.

According to the invention defined in the fourth aspect of the invention, when the spacer is inserted upward into the spacer insert recessed part of the connector housing from a lower part, the spacer can be positioned at the temporarily engaged position. When the spacer is more pushed in to an interior part, the spacer can be positioned at the mainly engaged position. At that time, under a state that the spacer is located in the temporarily engaged position, the terminal can be inserted into the terminal insert hole by bending the lance. Further, under a state that the lance is temporarily engaged with the terminal, when the spacer is more pushed in to the inner mainly engaged position, the mainly terminal engaging part provided in the spacer is mainly engaged with the terminal. Thus, the terminal can be assuredly prevented from slipping out and fixed. Since the engaging edge part of the engaging protrusion part provided as the mainly terminal engaging part is formed as an edge part substantially parallel to the transverse direction and the engaging edge part of the lance provided at the obliquely upper position of the terminal insert hole of the spacer is provided as an edge part orthogonal to the bending direction of the lance, an angle larger than 0° and smaller than 90° can be provided between the engaging edge part of the engaging protrusion art and the engaging edge part of the lance, and the engaging edge parts can be employed for controlling the position of the terminal in the rotating direction.

Further, according to the invention defined in the fifth aspect of the invention, since the round terminal is used as the terminal, the engaging edge part of the engaging protrusion part and the engaging edge part of the lance of the spacer are fitted to the engaging recessed part of the terminal, and further, the engaging edge part of the engaging protrusion part and the engaging edge part of the lance of the spacer are pressed to come into contact with the rotating direction position control part of the terminal, the position in the rotating direction of the round terminal which is inserted without caring about the orientation during the temporary engagement of the lance can be corrected to a position suitable for the lance. As described above, when the spacer is pushed in to the mainly engaged position during a shift from the temporarily engaged state to the mainly engaged state, the round terminal can be corrected to a proper engaged position by a pushing operation of the spacer. Thus, even when the round terminal is used, the terminal can be automatically positioned to a proper position and assembled in a final assembly stage.

According to the invention defined in the sixth aspect of the invention, since an angle formed by the engaging edge part of the engaging protrusion part and the engaging edge part of the lance is set to a range of 30° to 60°, even when the terminal is inserted in any direction, the direction of the terminal can be finally corrected to a proper direction to mainly engage the terminal.

BRIEF DESCRIPTION OF THE DRAWINGS

FIGS. 11(*a*) to 11(*c*) show states that angles of an engaging edge part of a lance relative to an engaging edge part of an engaging protrusion part are larger in order as shown by θ1 to θ3.

FIG. 12(*a*) is a perspective view showing an entire structure of the round terminal and FIG. 12(*b*) is a front view of a cylindrical box part located in a front part of the round terminal.

FIG. 13(*a*) is a front view and FIG. 13(*b*) is a sectional view taken along a line A-A in FIG. 13(*a*).

FIG. 14(*a*) is a front view and FIG. 14(*b*) is a sectional view taken along a line A-A in FIG. 14(*a*).

FIG. 15(*a*) is a diagram showing a state that the round terminal is primarily engaged (temporarily engaged) with the lance of the spacer and FIG. 15(*b*) is a diagram showing a state that the spacer is pressed to a mainly engaged position and the round terminal is secondarily engaged (mainly engaged) with the engaging protrusion part of the spacer.

FIG. 16(*a*) is a diagram showing a state that the round terminal is primarily engaged (temporarily engaged) with the lance of the spacer and FIG. 16(*b*) is a diagram showing a state that the spacer is pressed to a mainly engaged position and the round terminal is secondarily engaged (mainly engaged) with the engaging protrusion part of the spacer.

FIG. 17(*a*) is a diagram showing a relation between the engaging part of the round terminal and the lance when the round terminal is inserted in an arbitrary direction. FIG. 17(*b*) is a diagram showing a relation between the engaging part of the round terminal and the lance during a primary engagement (a temporary engagement).

FIG. 18(*a*) is a front view during the primary engagement. FIG. 18(*b*) is a front view showing a state that the spacer is pressed to the mainly engaged position from the temporarily engaged position so that a turning force or torque is applied to the round terminal. FIG. 18(*c*) is a front view during the secondary engagement.

DESCRIPTION OF THE PREFERRED EMBODIMENTS

Figure 1:
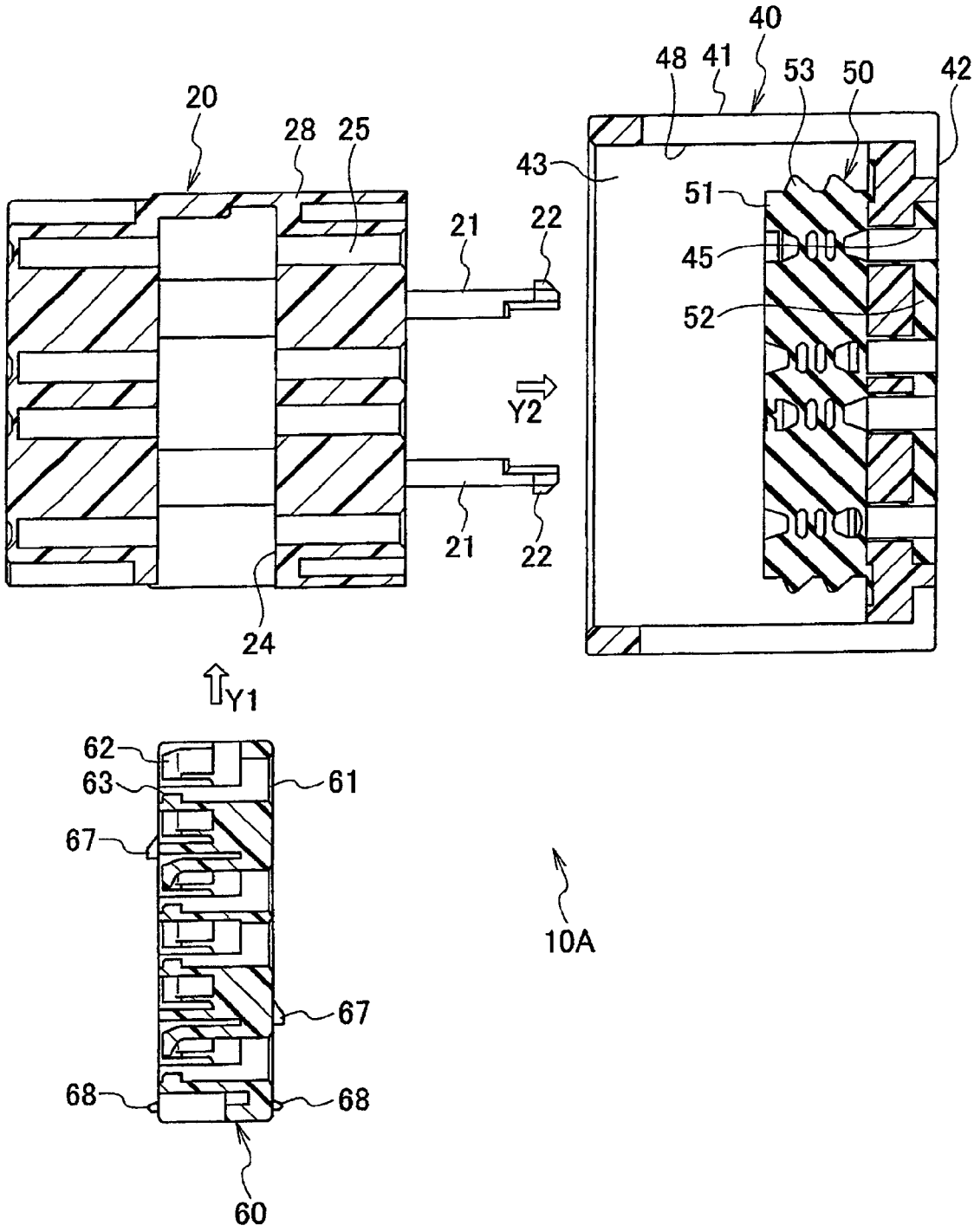
FIG. 1 is a side sectional view showing a relation between an inner housing, an outer housing and a spacer which form a connector housing of a connector of an exemplary embodiment of the present invention.

Now, an exemplary embodiment of the present invention will be described below by referring to the drawings.

Figure 2:
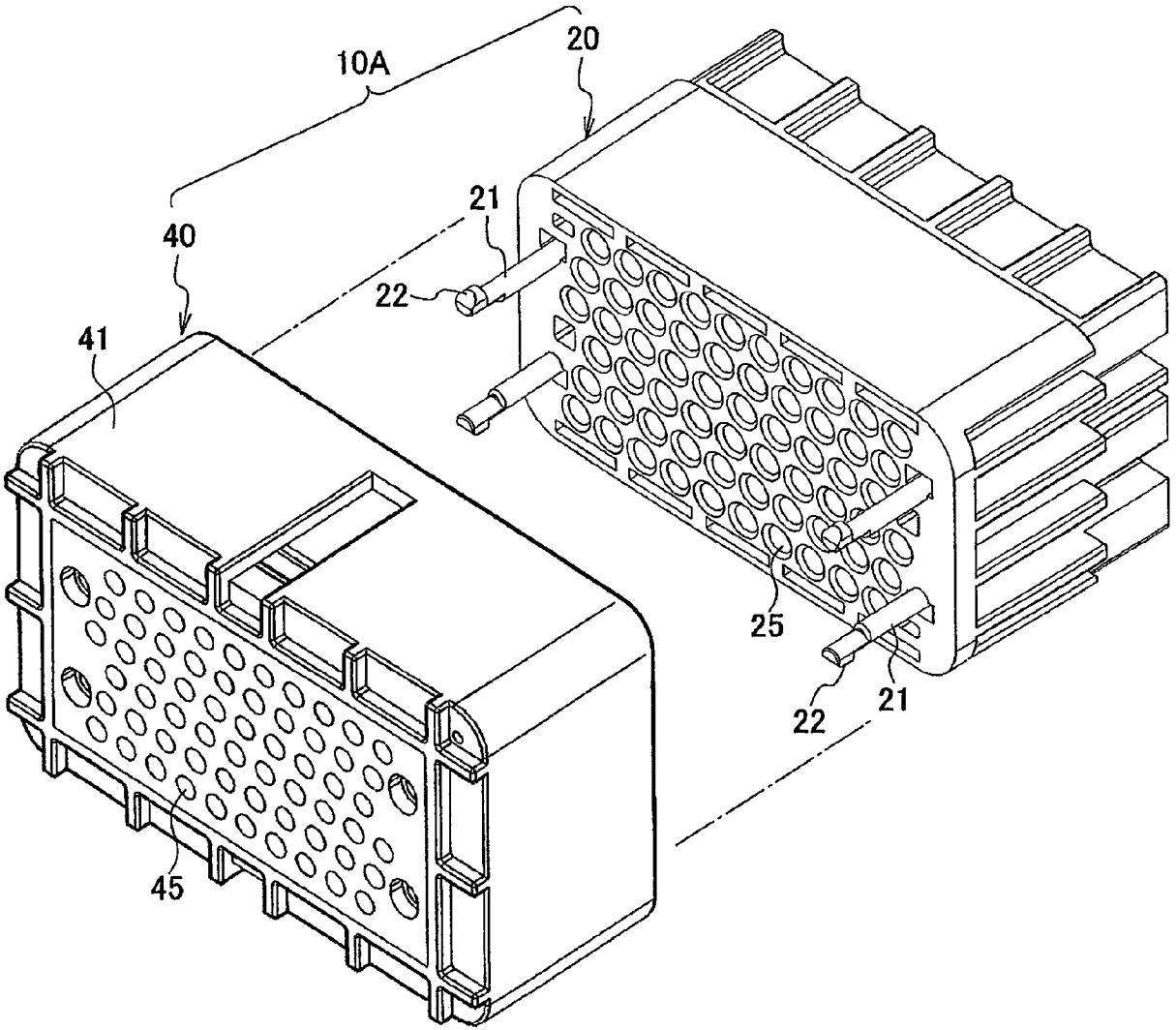
FIG. 2 is a perspective view showing a relation between the inner housing and the outer housing.
Figure 3:
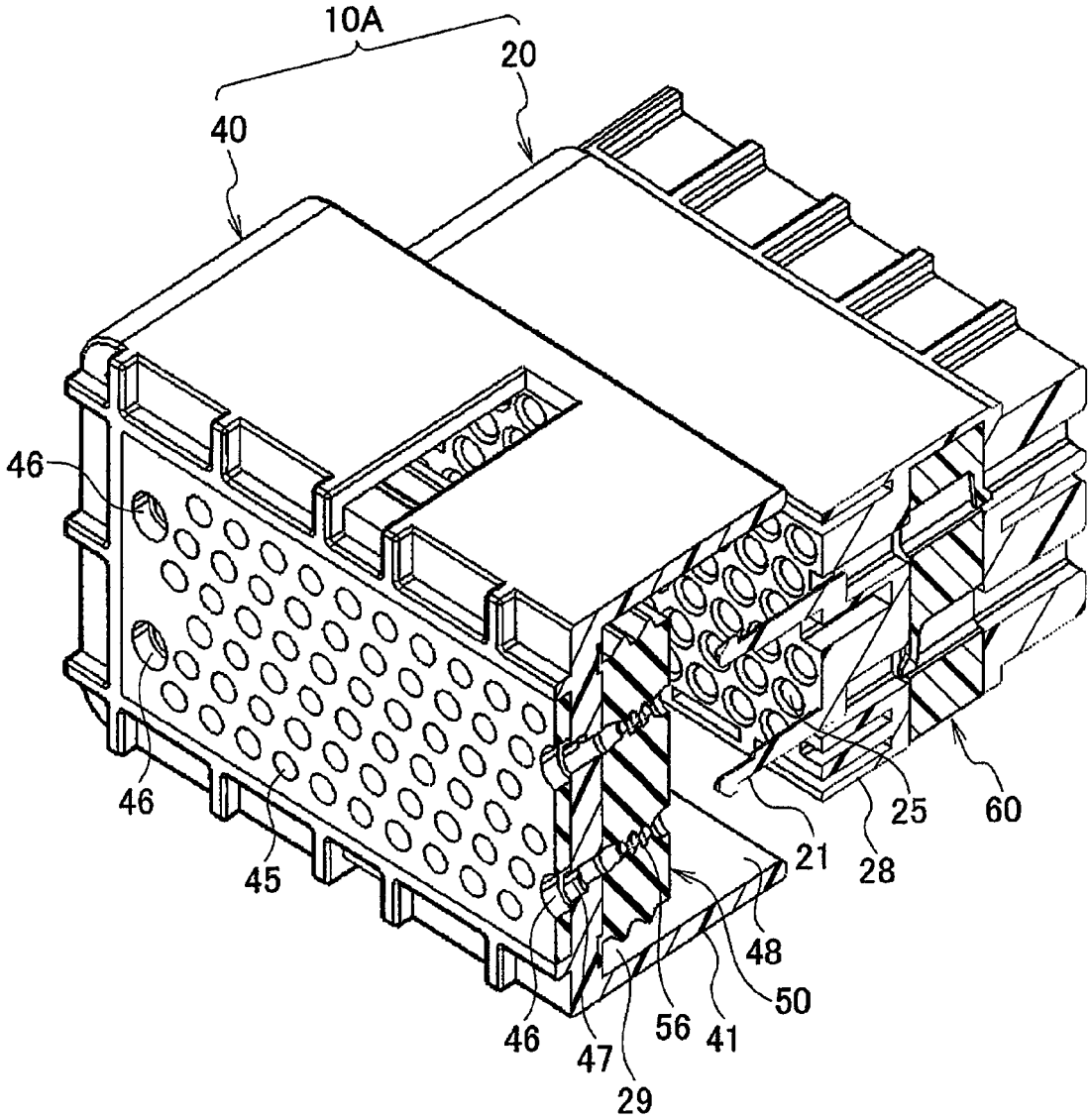
FIG. 3 is a partly broken perspective view showing the inner housing and the outer housing.
Figure 4:
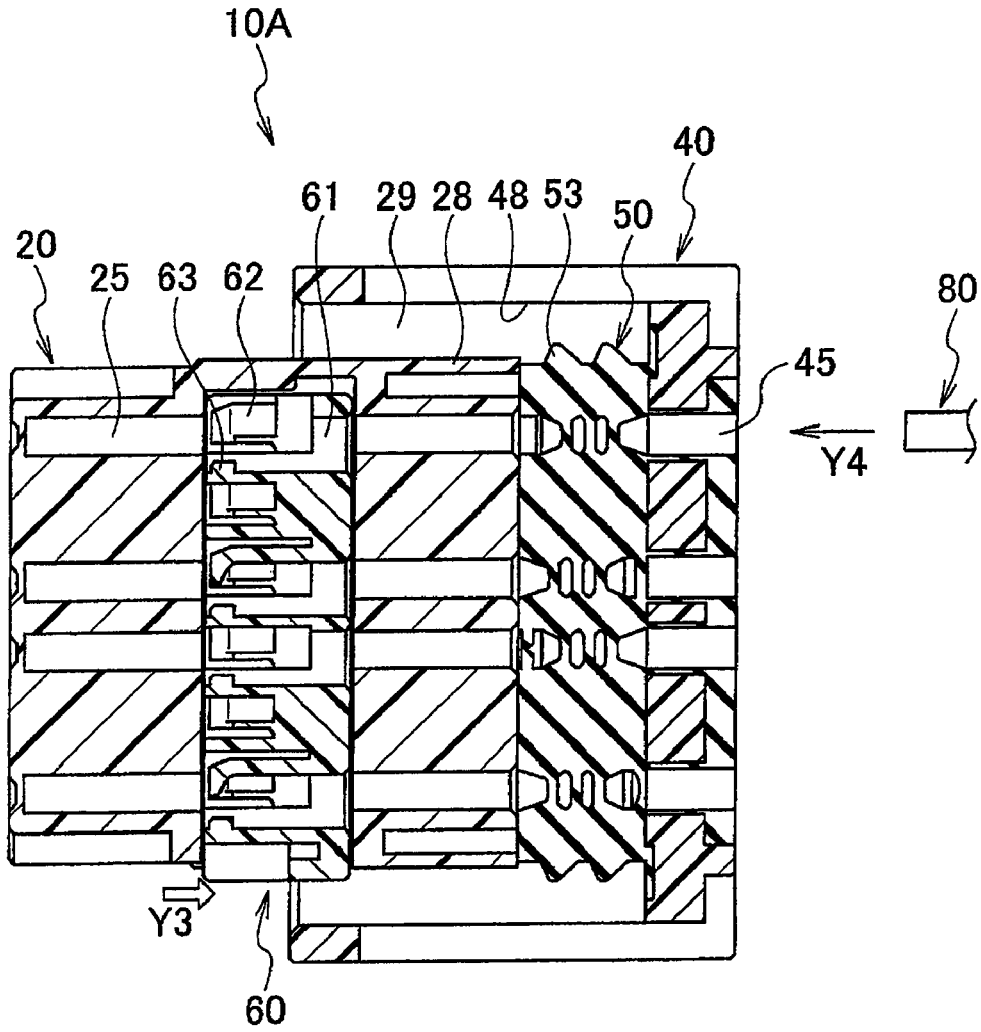
FIG. 4 is a side sectional view showing a state that the inner housing with which the spacer is temporarily engaged is attached to the outer housing.
Figure 5:
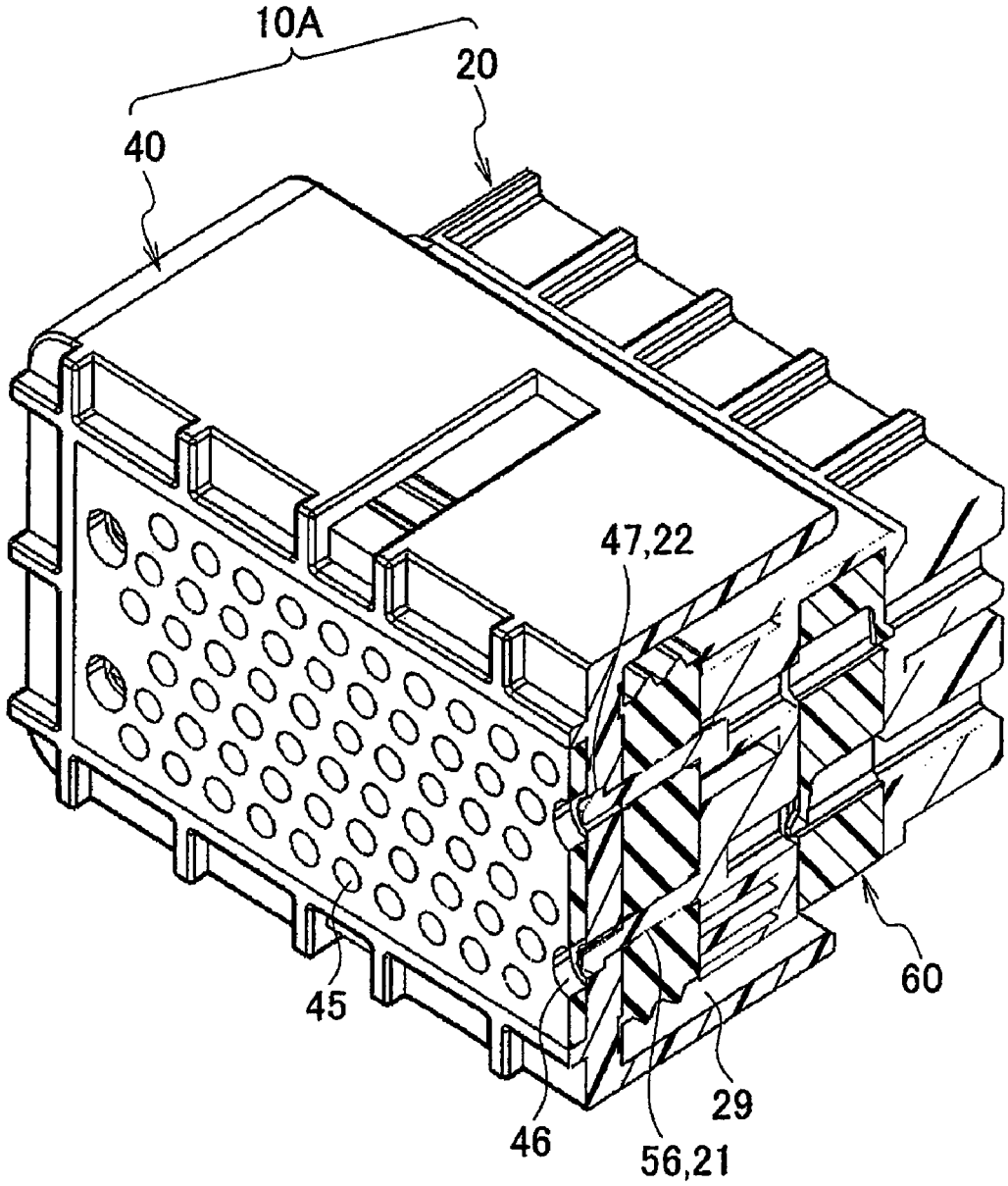
FIG. 5 is partly broken perspective view showing the state illustrated in FIG. 4.
Figure 6:
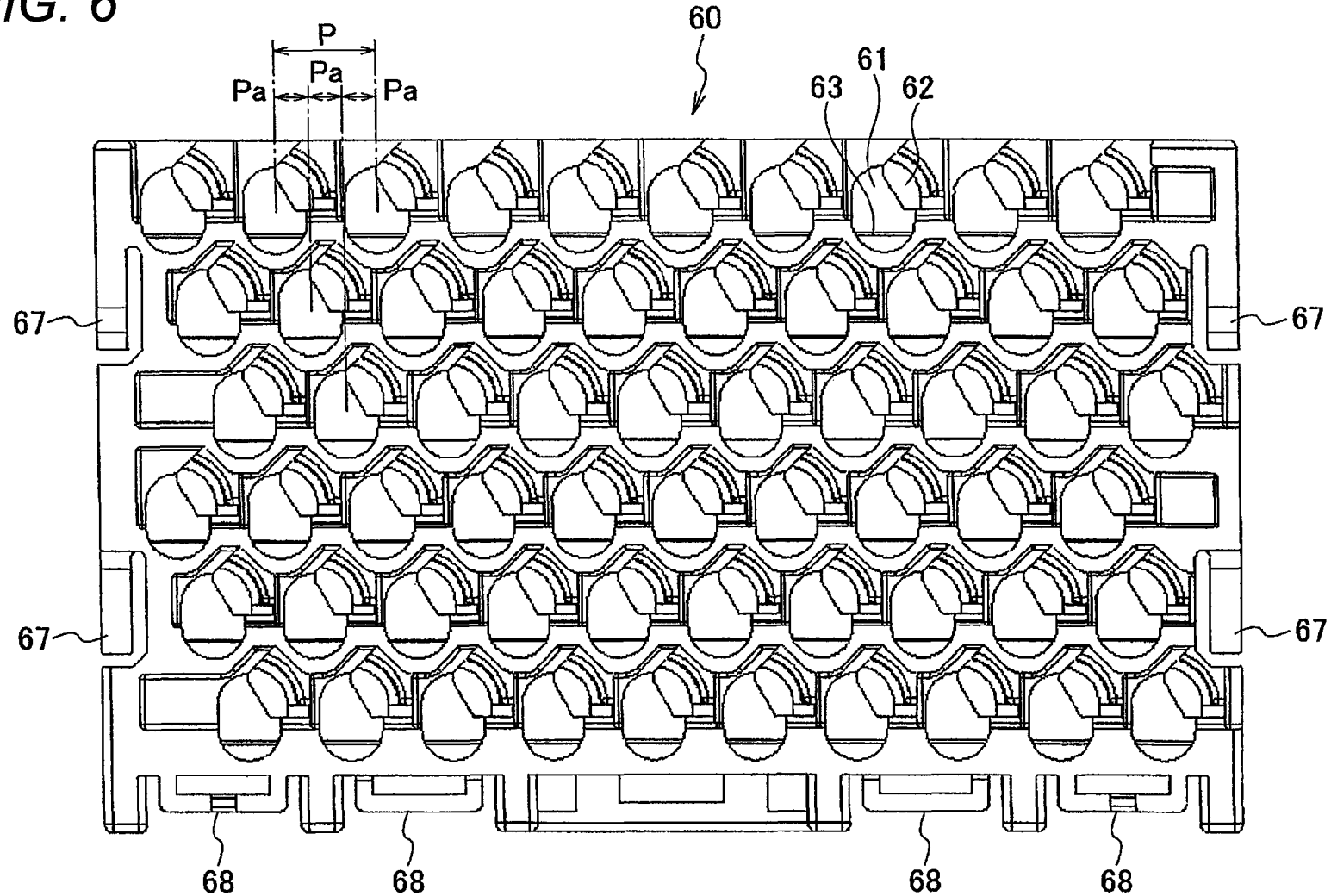
FIG. 6 is a front view of the spacer.
Figure 7:
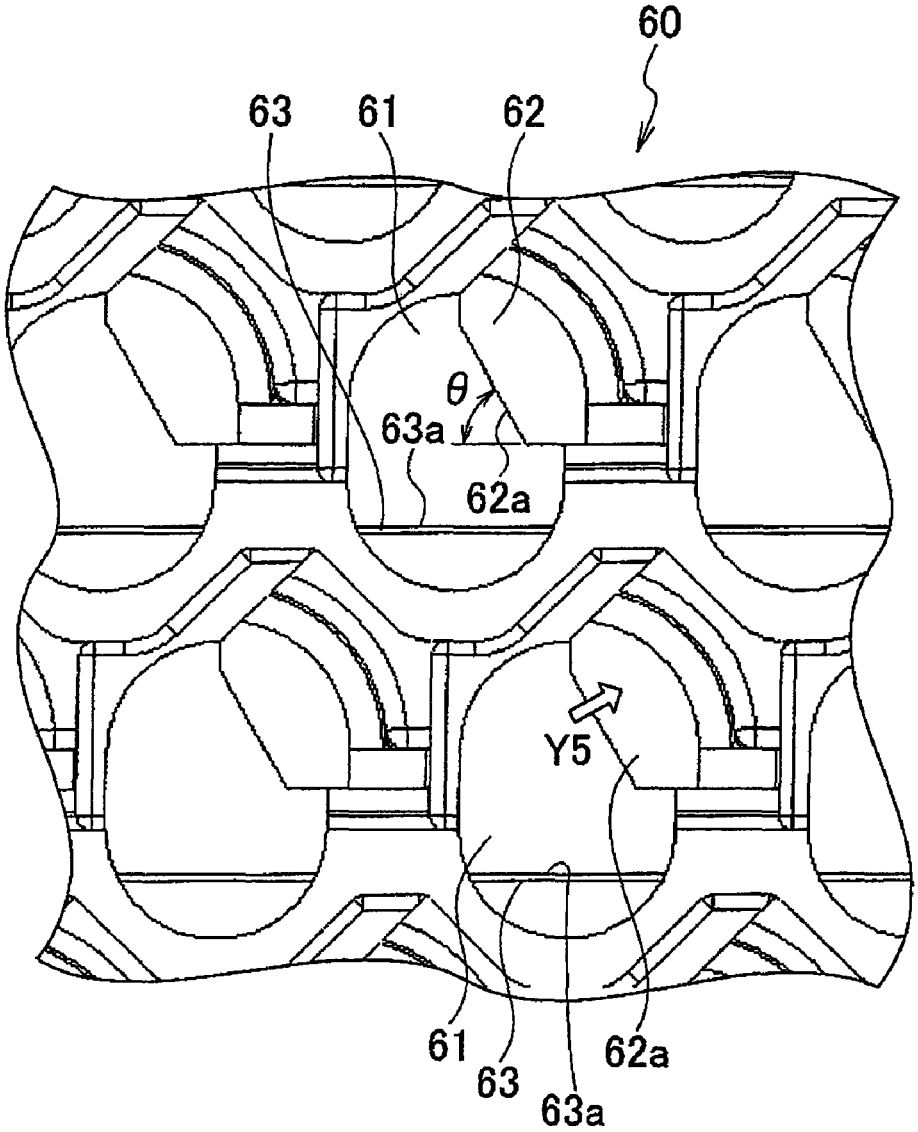
FIG. 7 is a partly enlarged view of FIG. 6.
Figure 8:
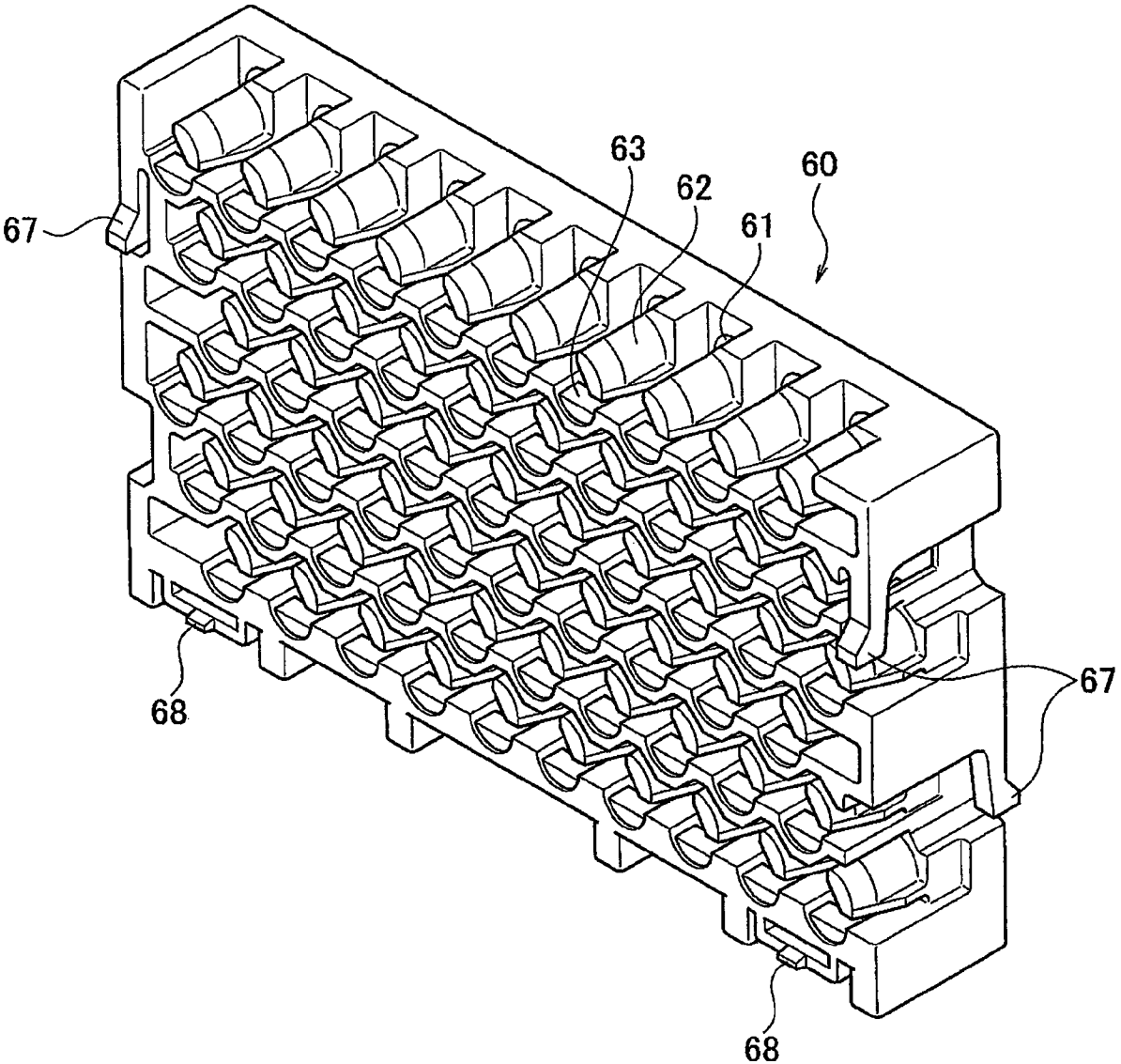
FIG. 8 is a perspective view of the spacer seen from a front surface side.
Figure 9:
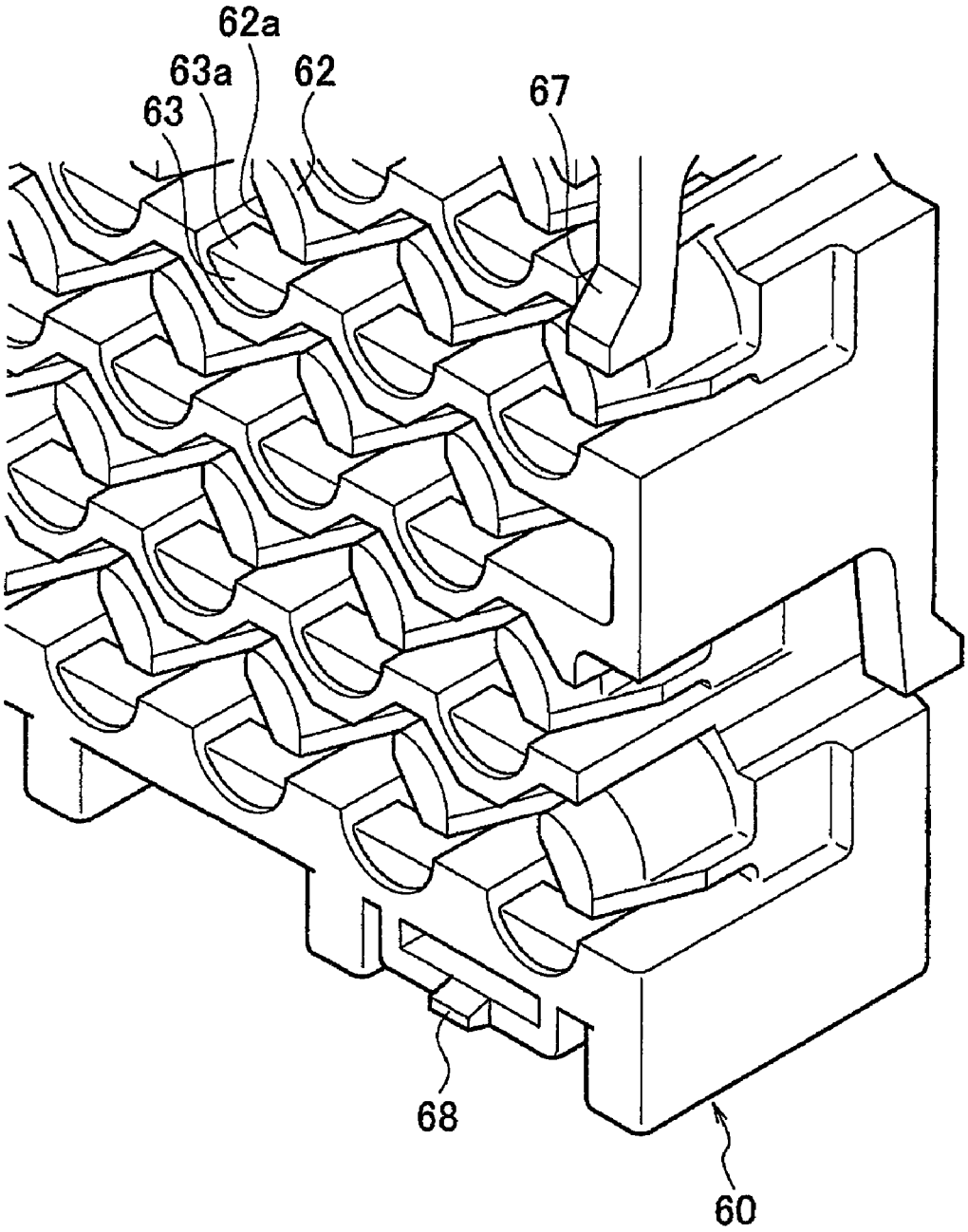
FIG. 9 is a partly enlarged view of FIG. 8.
Figure 10:
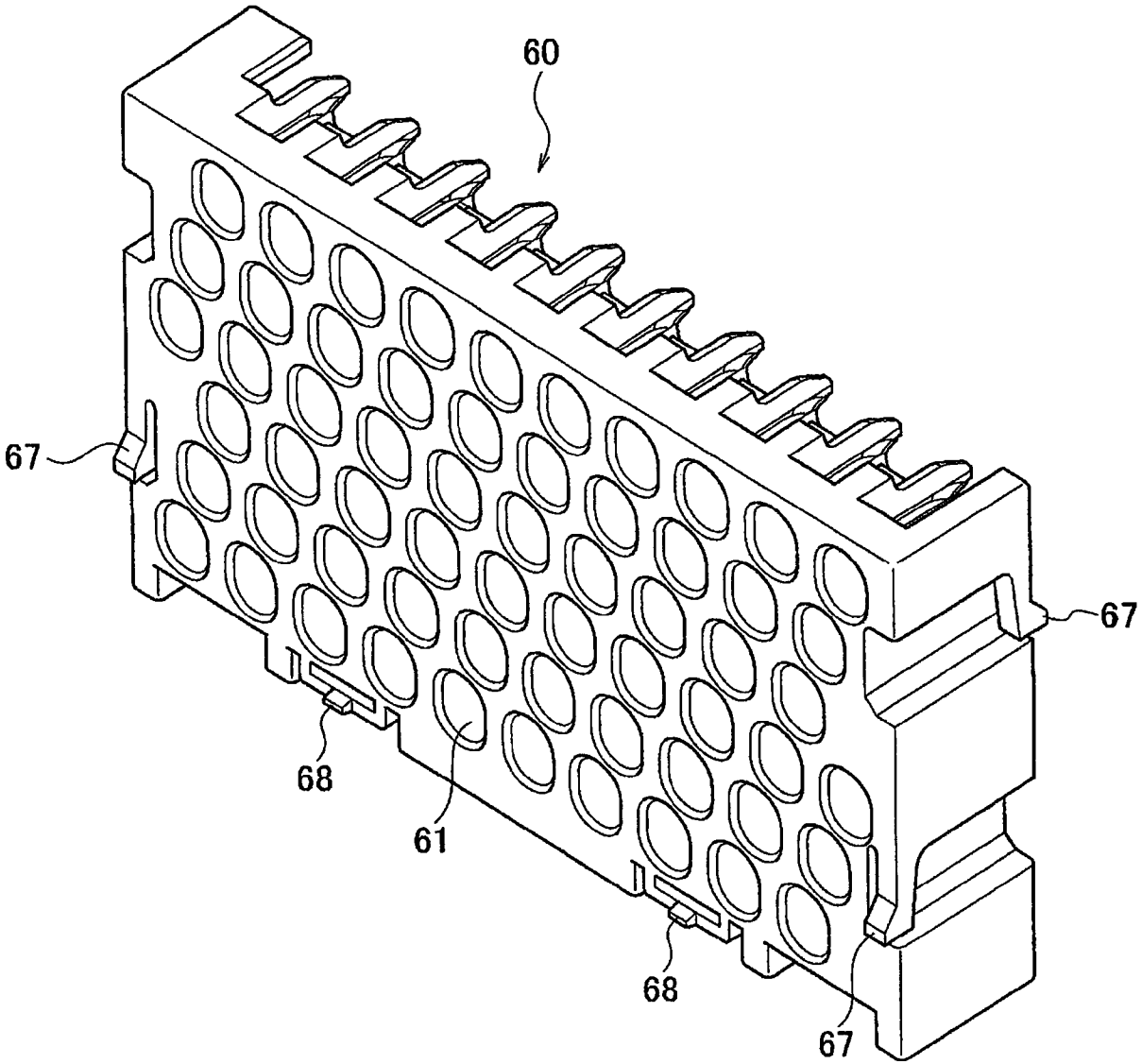
FIG. 10 is a perspective view seen from a rear surface side of the spacer.
Figure 11A:
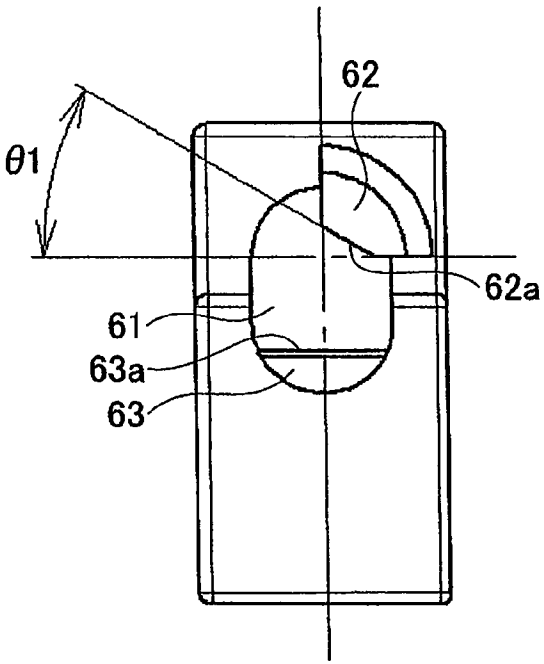
FIG. 11 is a front view of a terminal insert hole of the spacer.
Figure 11B:
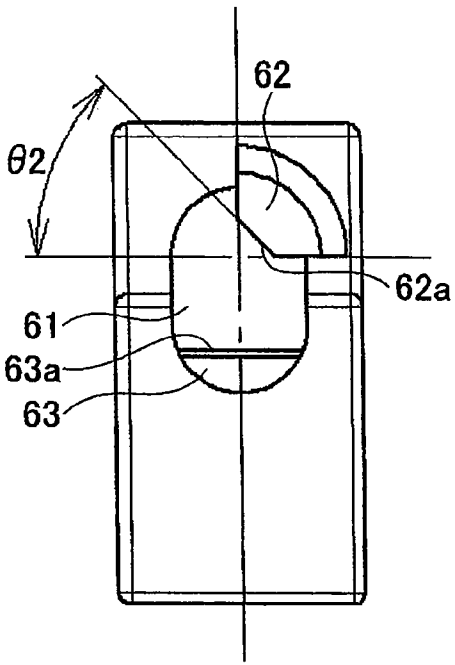
Figure 11C:
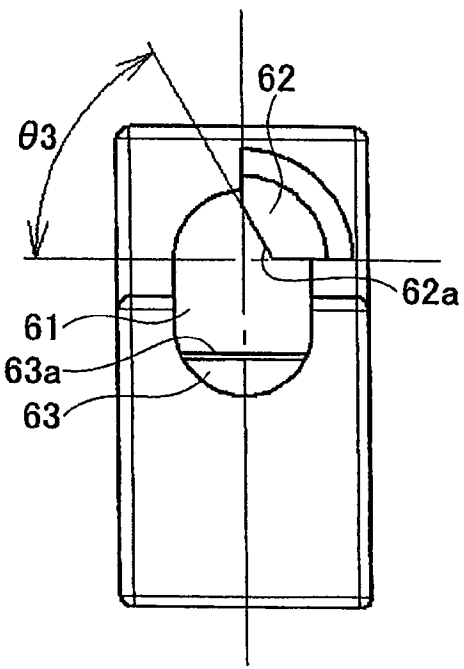

FIG. 1 is a side sectional view showing a relation between an inner housing 20, an outer housing 40 and a spacer 60 which form a connector housing 10A of a connector of an exemplary embodiment. FIG. 2 is a perspective view showing a relation between the inner housing 20 and the outer housing 40. FIG. 3 is a partly broken perspective view showing the inner housing 20 and the outer housing 40. FIG. 4 is a side sectional view showing a state that the inner housing 20 with which the spacer 60 is temporarily engaged is attached to the outer housing 40. FIG. 5 is partly broken perspective view showing the state illustrated in FIG. 4. FIG. 6 is a front view of the spacer 60. FIG. 7 is a partly enlarged view of FIG. 6. FIG. 8 is a perspective view of the spacer 60 seen from a front surface side. FIG. 9 is a partly enlarged view of FIG. 8. FIG. 10 is a perspective view seen from a rear surface side of the spacer 60. FIG. 11 is a front view of a terminal insert hole 61 of the spacer 60. FIGS. 11(*a*) to 11(*c*) show states that angles of an engaging edge part 62*a* of a lance 62 relative to an engaging edge part 63*a* of an engaging protrusion part 63 are larger in order as shown by θ1 to θ3.

Figure 12A:
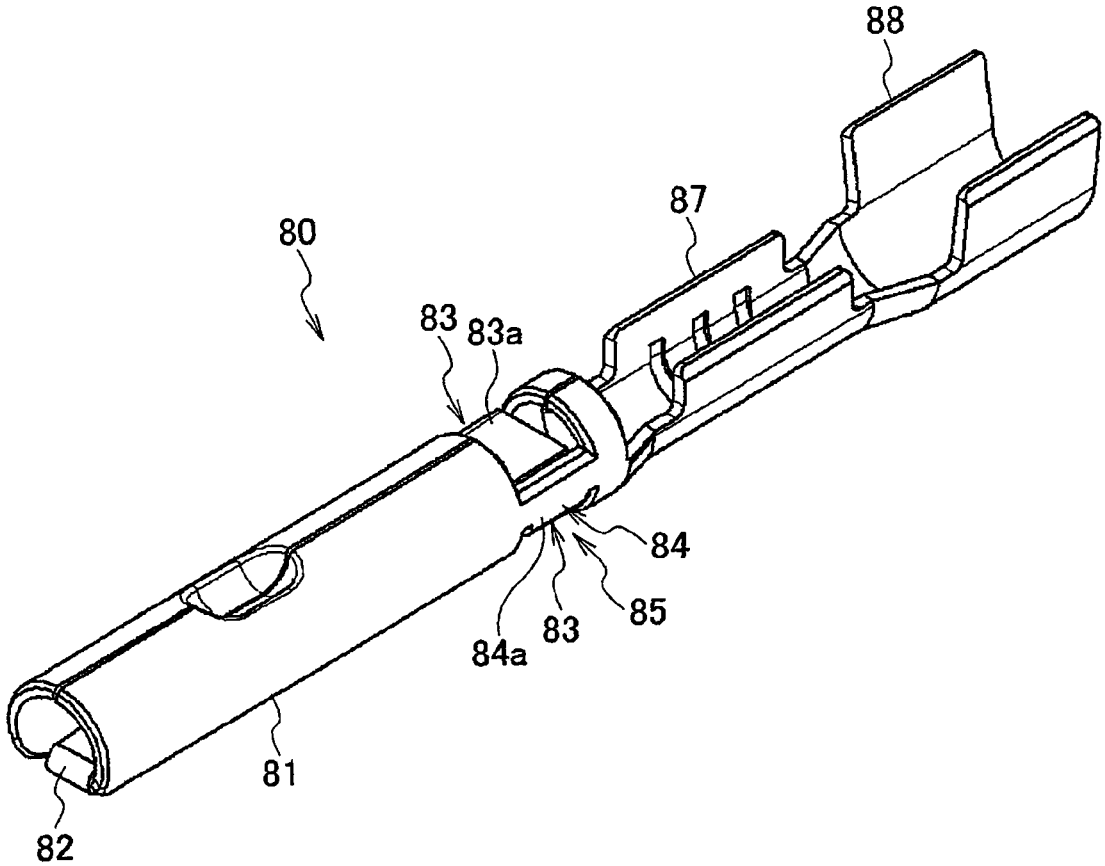
FIG. 12 is a diagram showing the structure of a female type round terminal used in the connector of the exemplary embodiment of the present invention.
Figure 12B:
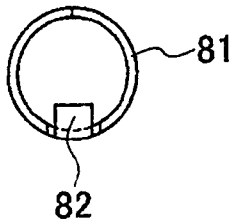
Figure 13B:
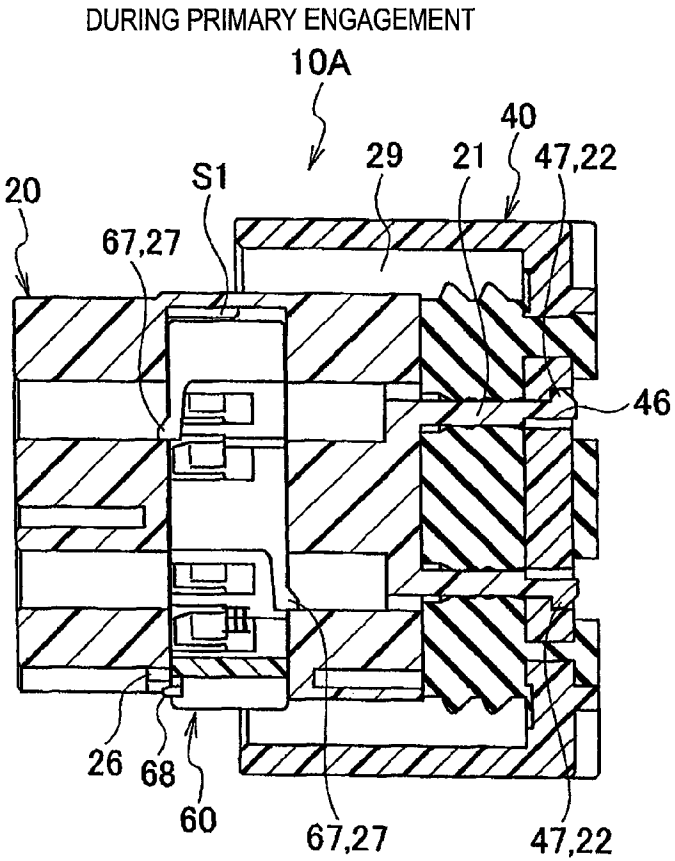
FIG. 13 is a diagram showing a state when the spacer is primarily engaged (temporarily engaged) with the inner housing in the connector housing.
Figure 13A:
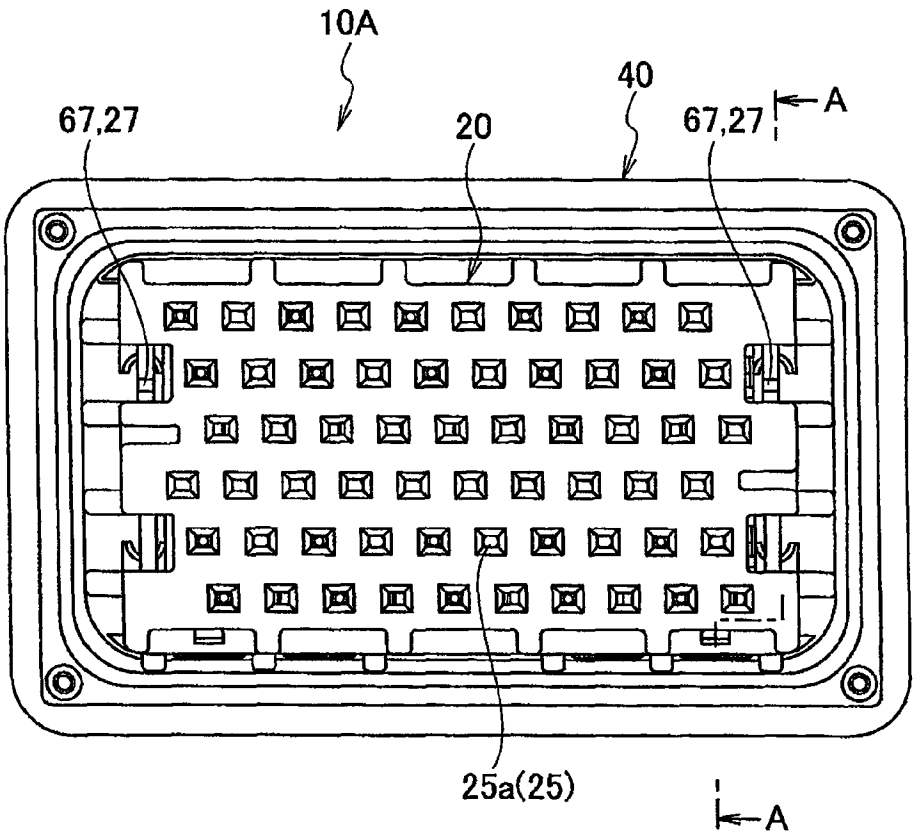
Figure 14B:
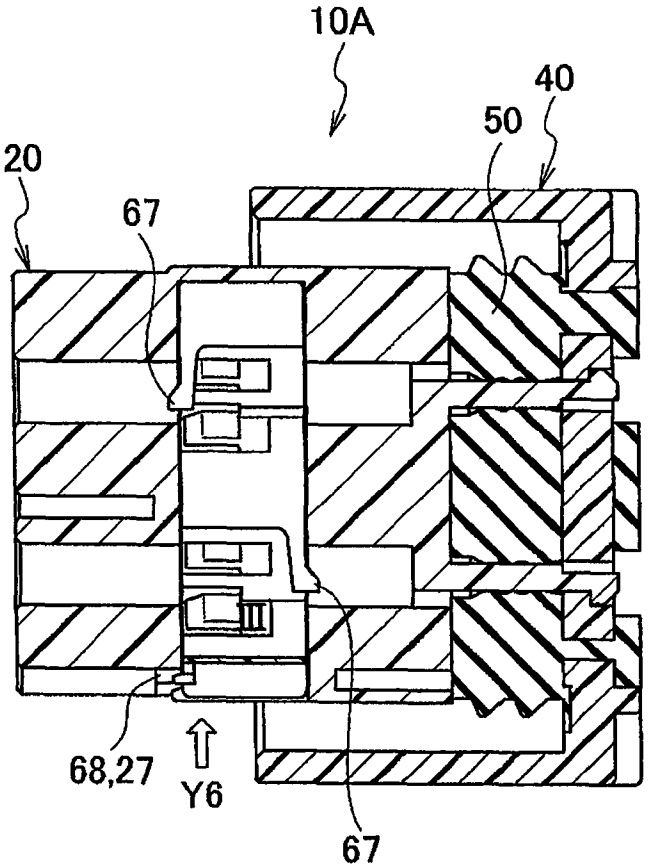
FIG. 14 is a diagram showing a state when the spacer is secondarily engaged (mainly engaged) with the inner housing in the connector housing.
Figure 14A:
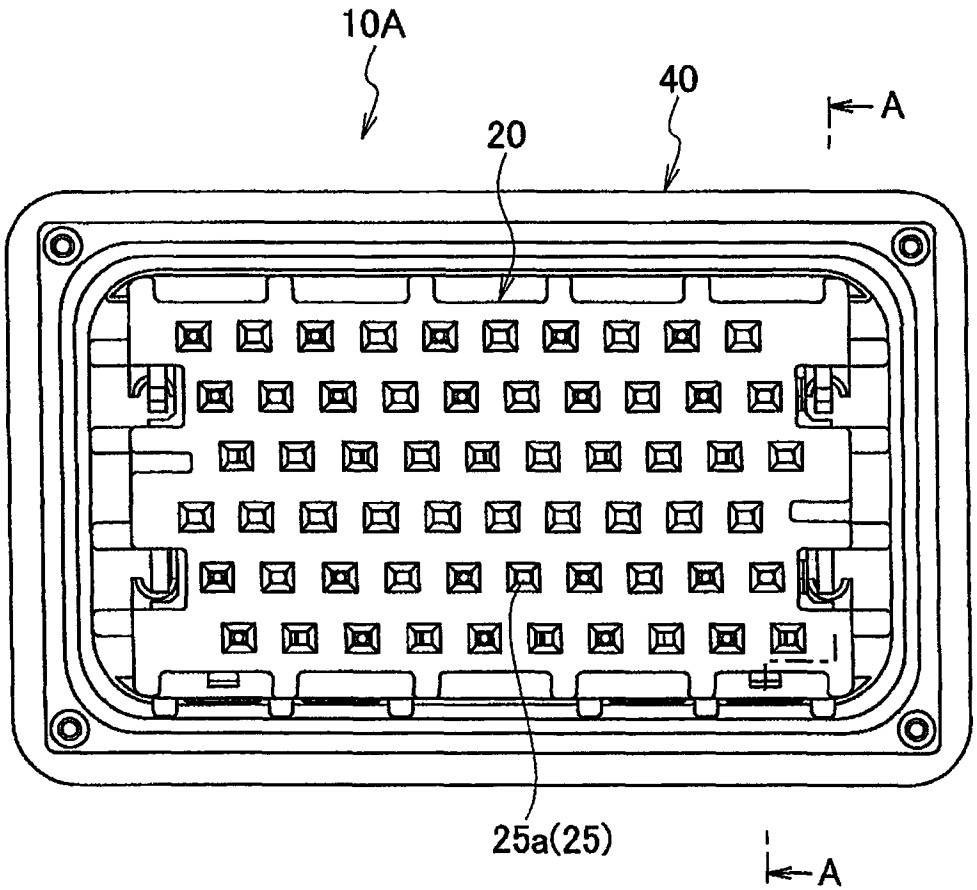
Figure 15B:
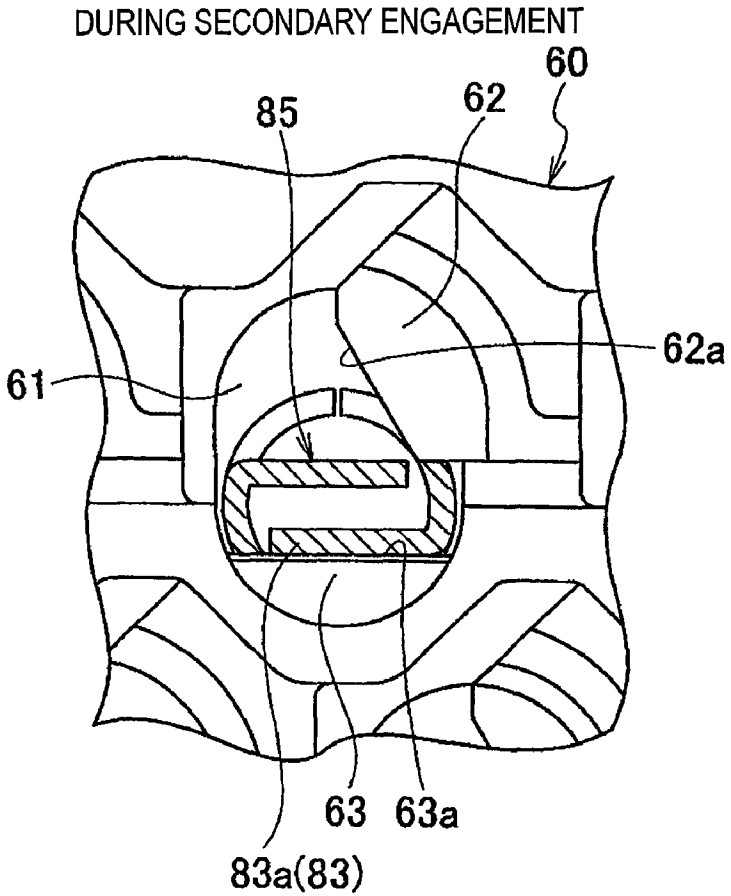
FIG. 15 is an enlarged front view showing a relation between the spacer and an engaging part of the round terminal.
Figure 15A:
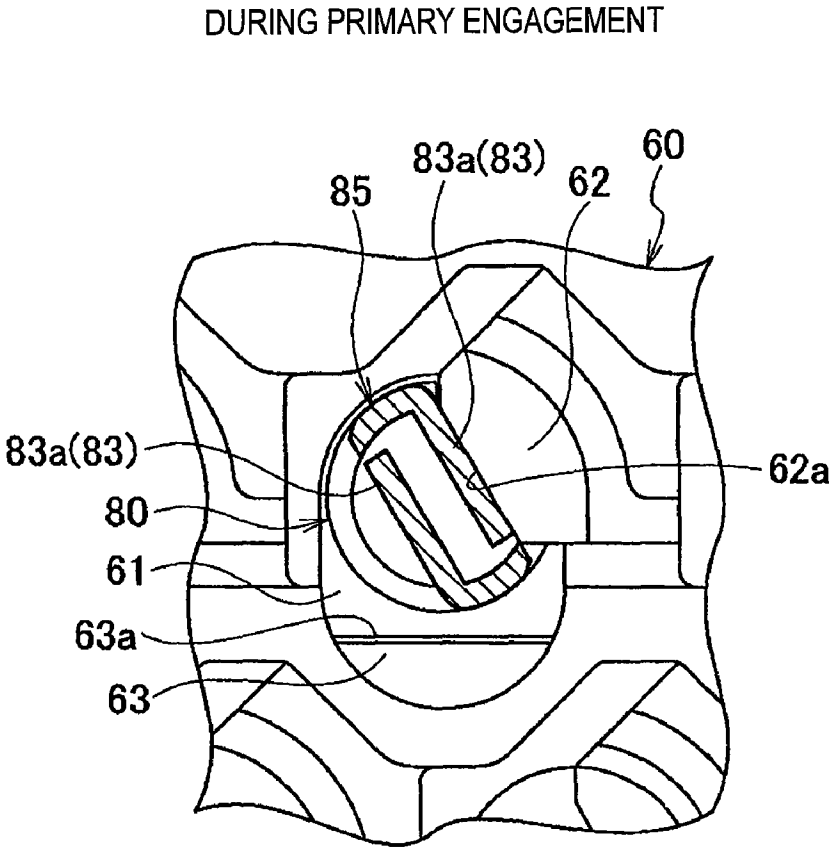
Figure 16A:
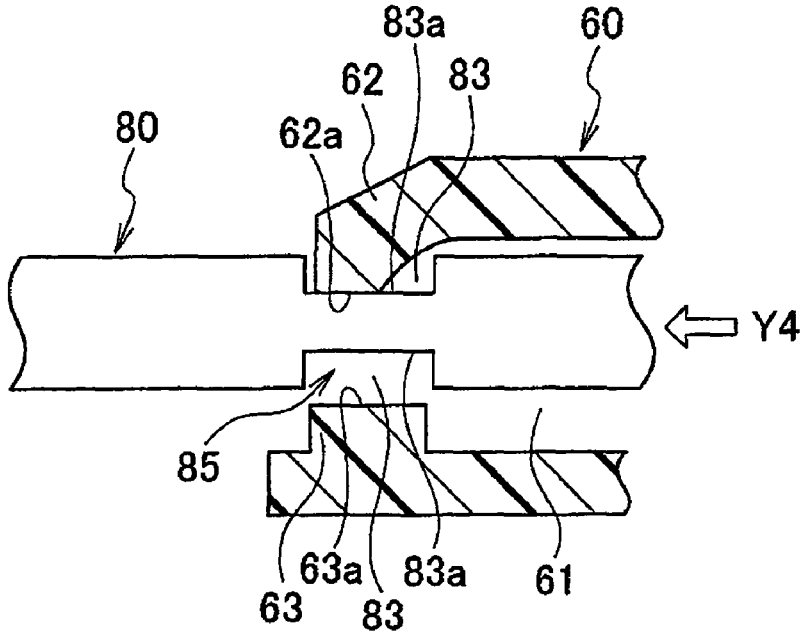
FIG. 16 is an enlarged side view showing the relation between the spacer and the engaging part of the round terminal which is illustrated for the purpose of convenience to assist one to understand FIG. 15.
Figure 16B:
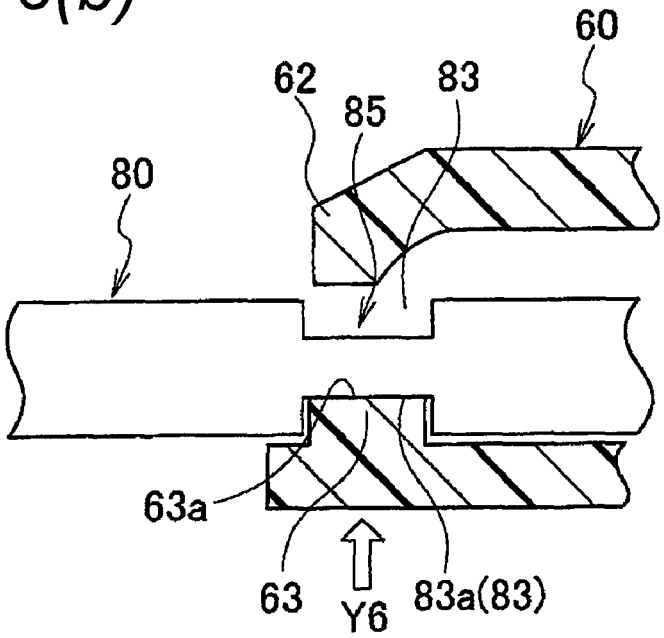
Figure 17B:
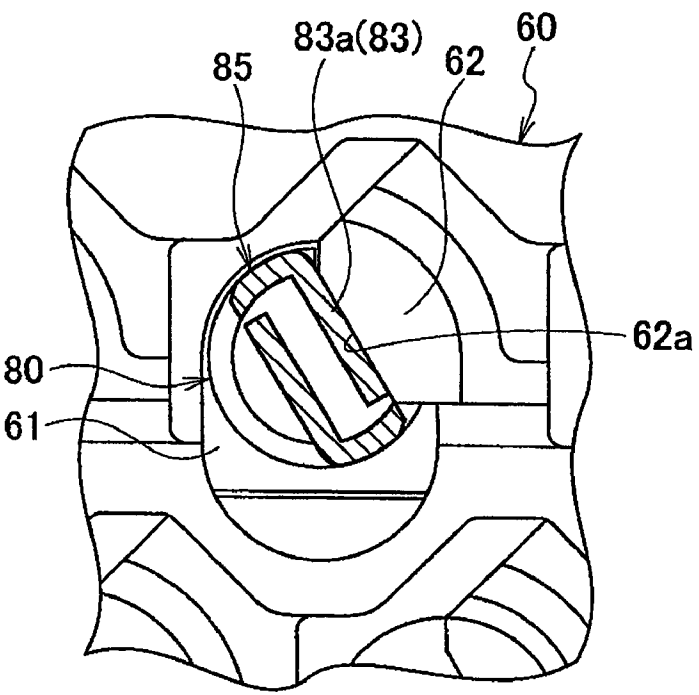
FIG. 17 is a front view showing a relation between the engaging part of the round terminal and the lance when the round terminal is inserted into the terminal insert hole of the spacer.
Figure 17A:
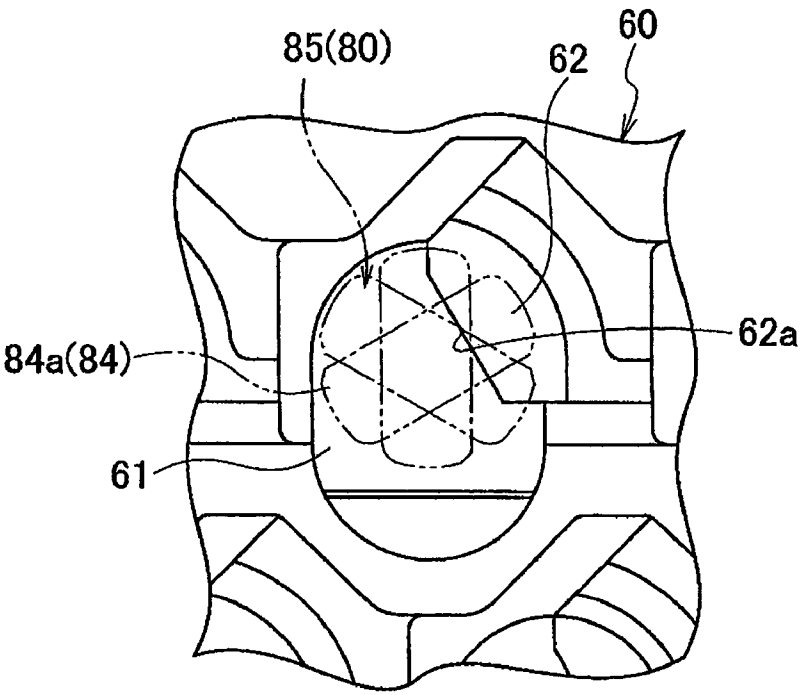
Figure 18A:
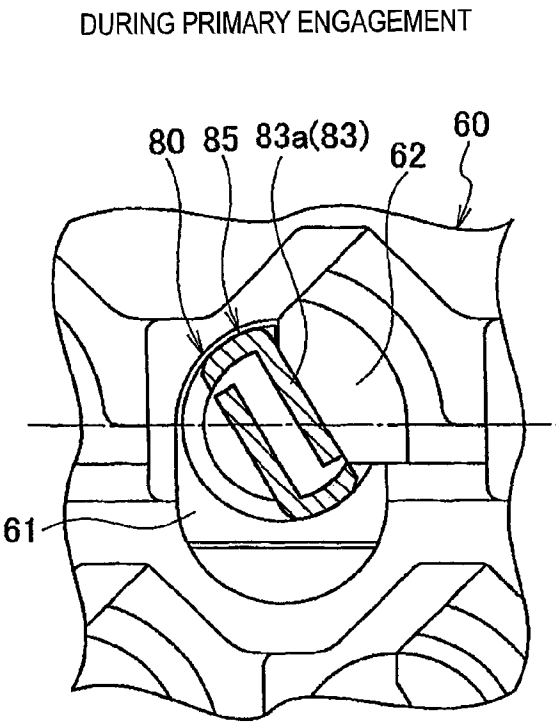
FIG. 18 is an explanatory view of contents of a position control of the round terminal when the primary engagement is shifted to the secondary engagement.
Figure 18B:
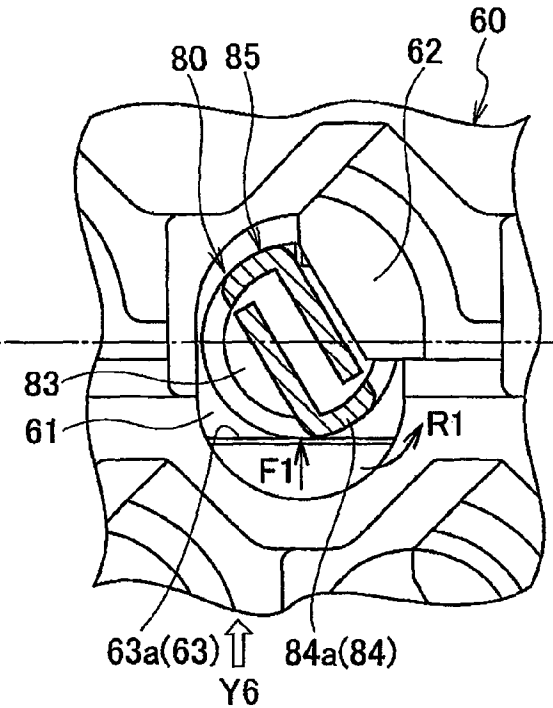
Figure 18C:
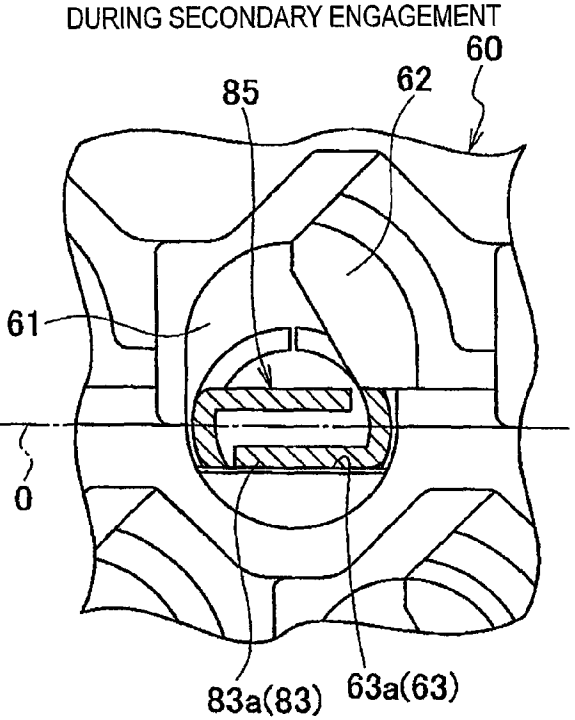

Further, FIG. 12 is a diagram showing the structure of a female type round terminal 80 used in the connector of the exemplary embodiment of the present invention. FIG. 12(*a*) is a perspective view showing an entire structure of the round terminal 80 and FIG. 12(*b*) is a front view of a cylindrical box part 81 located in a front part of the round terminal. FIG. 13 is a diagram showing a state when the spacer 60 is primarily engaged (temporarily engaged) with the inner housing 20 in the connector housing 10A. FIG. 13(*a*) is a front view and FIG. 13(*b*) is a sectional view taken along a line A-A in FIG. 13(*a*). FIG. 14 is a diagram showing a state when the spacer 60 is secondarily engaged (mainly engaged) with the inner housing 20 in the connector housing 10A. FIG. 14(*a*) is a front view and FIG. 14(*b*) is a sectional view taken along a line A-A in FIG. 14(*a*). FIG. 15 is an enlarged front view showing a relation between the spacer 60 and an engaging part 85 of the round terminal 80. FIG. 15(*a*) is a diagram showing a state that the round terminal 80 is primarily engaged (temporarily engaged) with the lance 62 of the spacer 60 and FIG. 15(*b*) is a diagram showing a state that the spacer 60 is pressed to a mainly engaged position and the round terminal 80 is secondarily engaged (mainly engaged) with the engaging protrusion part 63 of the spacer 60. FIG. 16 is an enlarged side view showing the relation between the spacer 60 and the engaging part 85 of the round terminal 80 which is illustrated for the purpose of convenience to assist one to understand FIG. 15. FIG. 16(*a*) is a diagram showing a state that the round terminal 80 is primarily engaged (temporarily engaged) with the lance 62 of the spacer 60 and FIG. 16(*b*) is a diagram showing a state that the spacer 60 is pressed to a mainly engaged position and the round terminal 80 is secondarily engaged (mainly engaged) with the engaging protrusion part 63 of the spacer 60. FIG. 17 is a front view showing a relation between the engaging part 85 of the round terminal 80 and the lance 62 when the round terminal 80 is inserted into the terminal insert hole 61 of the spacer 60. FIG. 17(*a*) is a diagram showing a relation between the engaging part of the round terminal and the lance 62 when the round terminal 80 is inserted in an arbitrary direction. FIG. 17(*b*) is a diagram showing a relation between the engaging part 85 of the round terminal 80 and the lance 62 during a primary engagement (a temporary engagement). FIG. 18 is an explanatory view of contents of a position control of the round terminal when the primary engagement is shifted to the secondary engagement. FIG. 18(*a*) is a front view during the primary engagement. FIG. 18(*b*) is a front view showing a state that the spacer 60 is pressed to the mainly engaged position from the temporarily engaged position so that a turning force or torque is applied to the round terminal 80. FIG. 18(*c*) is a front view during the secondary engagement.

Figure 19:
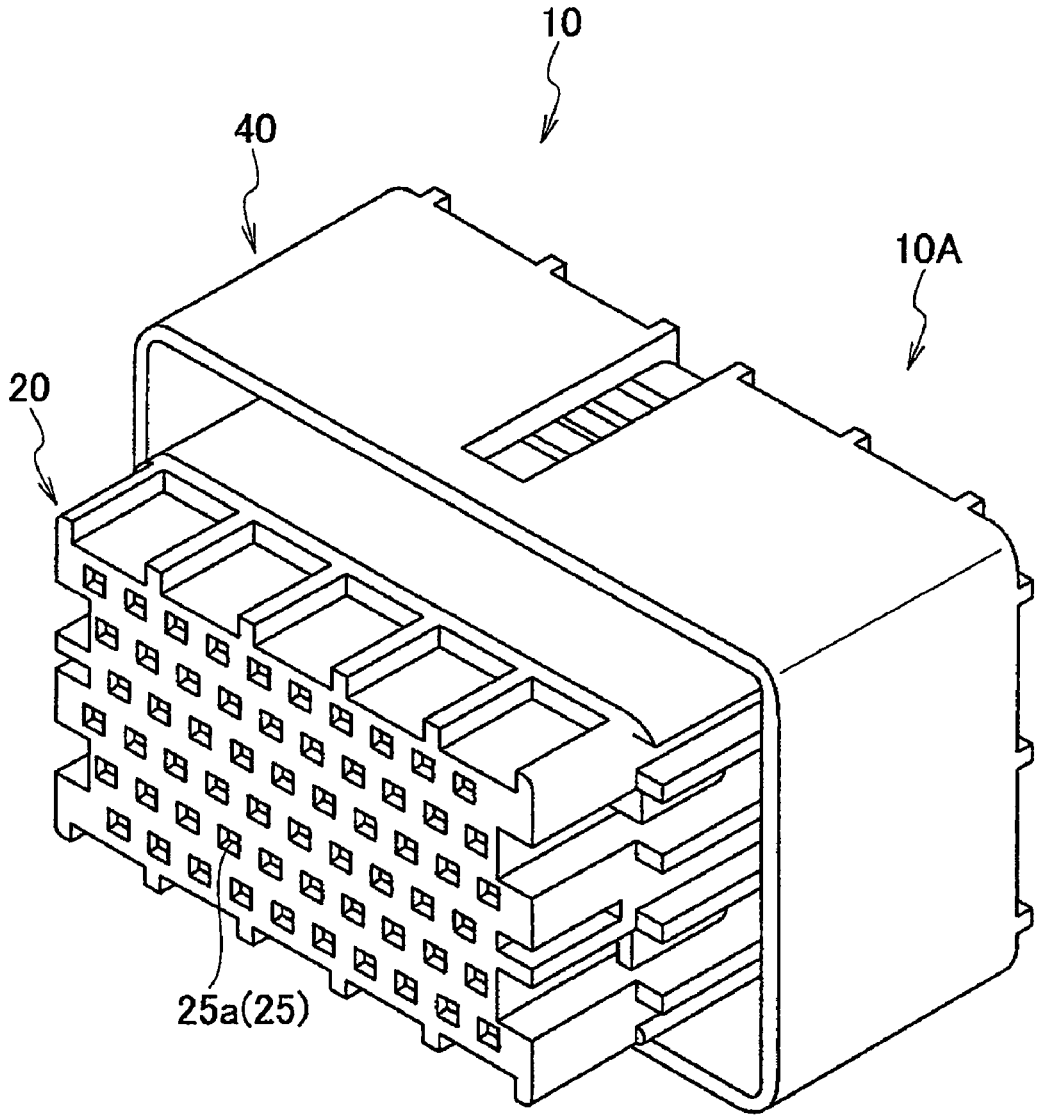
FIG. 19 is a perspective view of an external appearance of the connector of the exemplary embodiment of the present invention seen from a front side when an assembling operation is completed.
Figure 20:
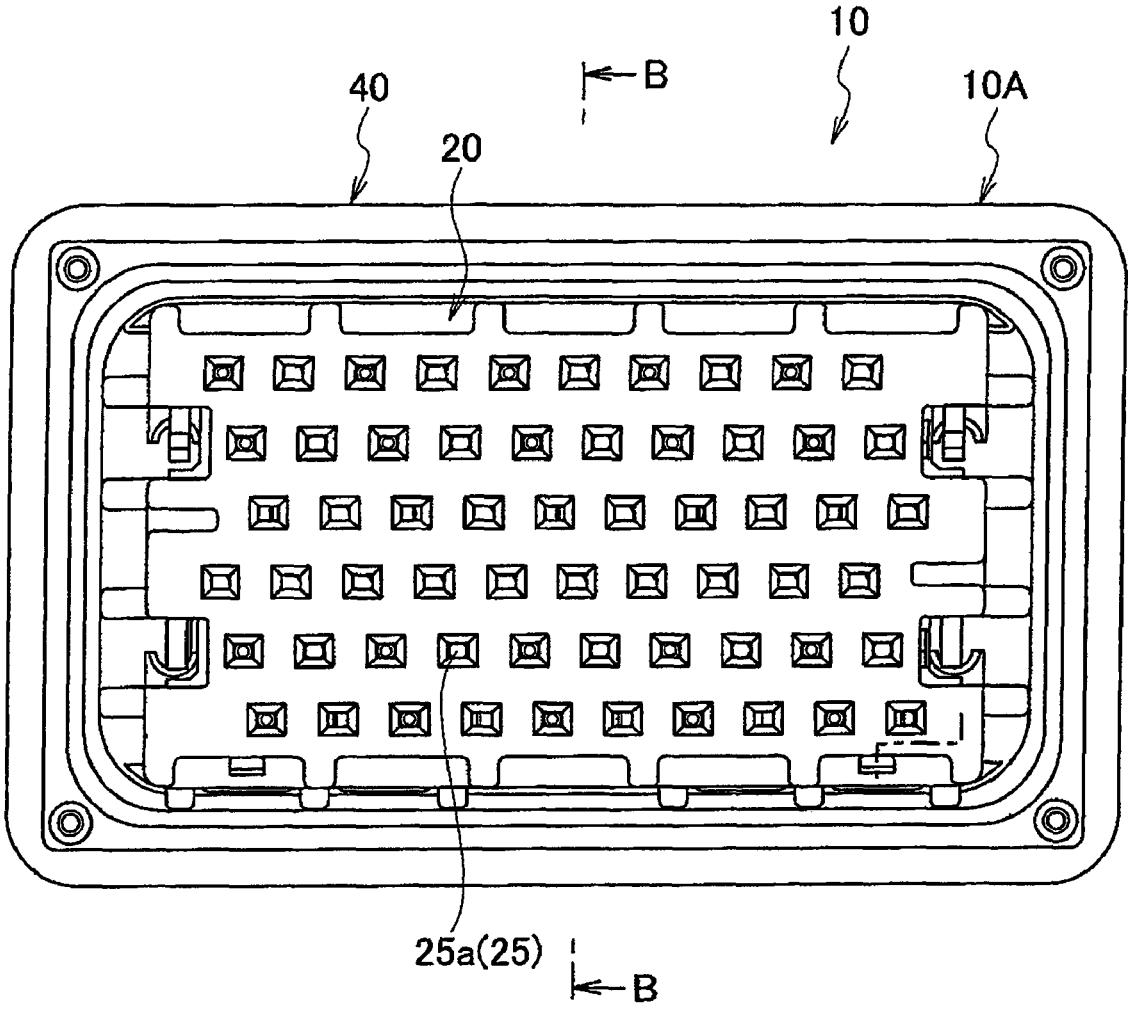
FIG. 20 is a front view of the connector seen from the front side.
Figure 21:
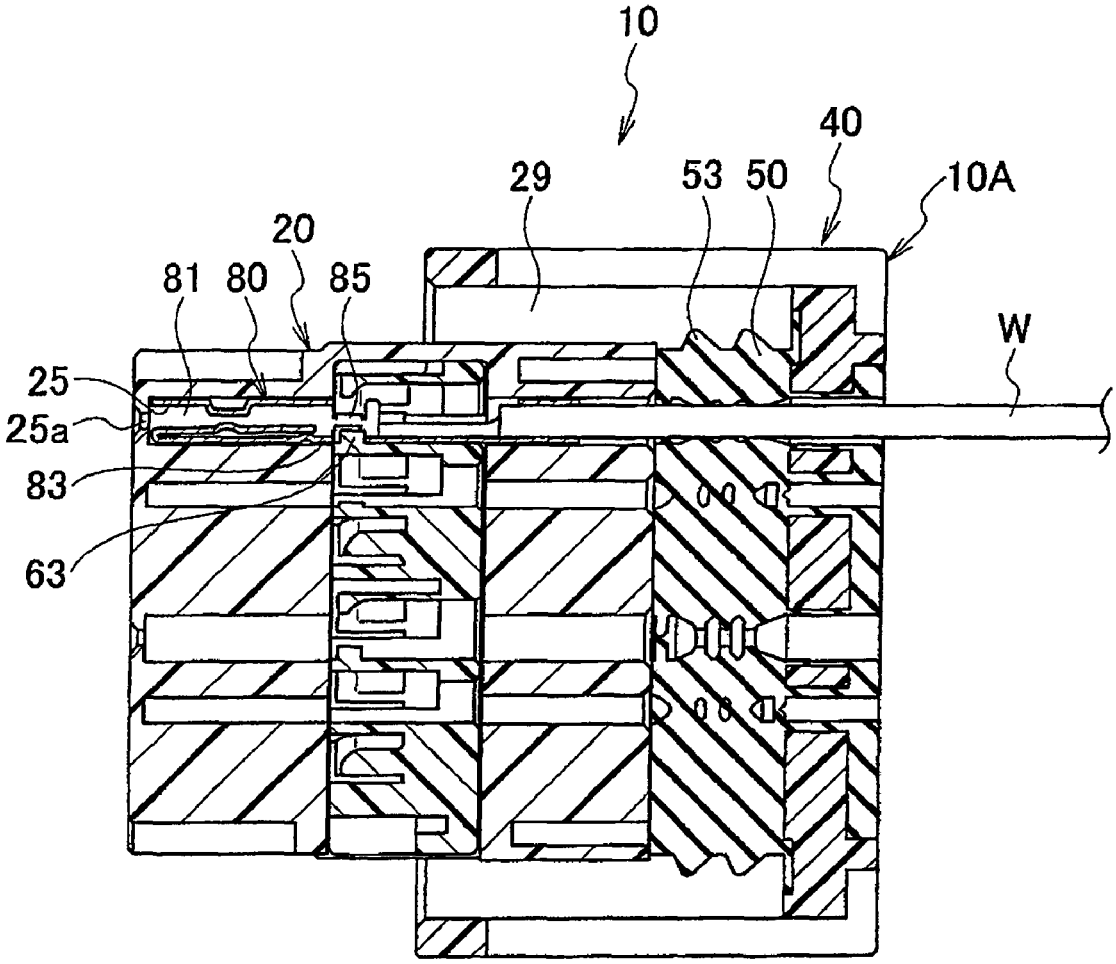
FIG. 21 is a sectional view taken along a line B-B in FIG. 20.
Figure 22:
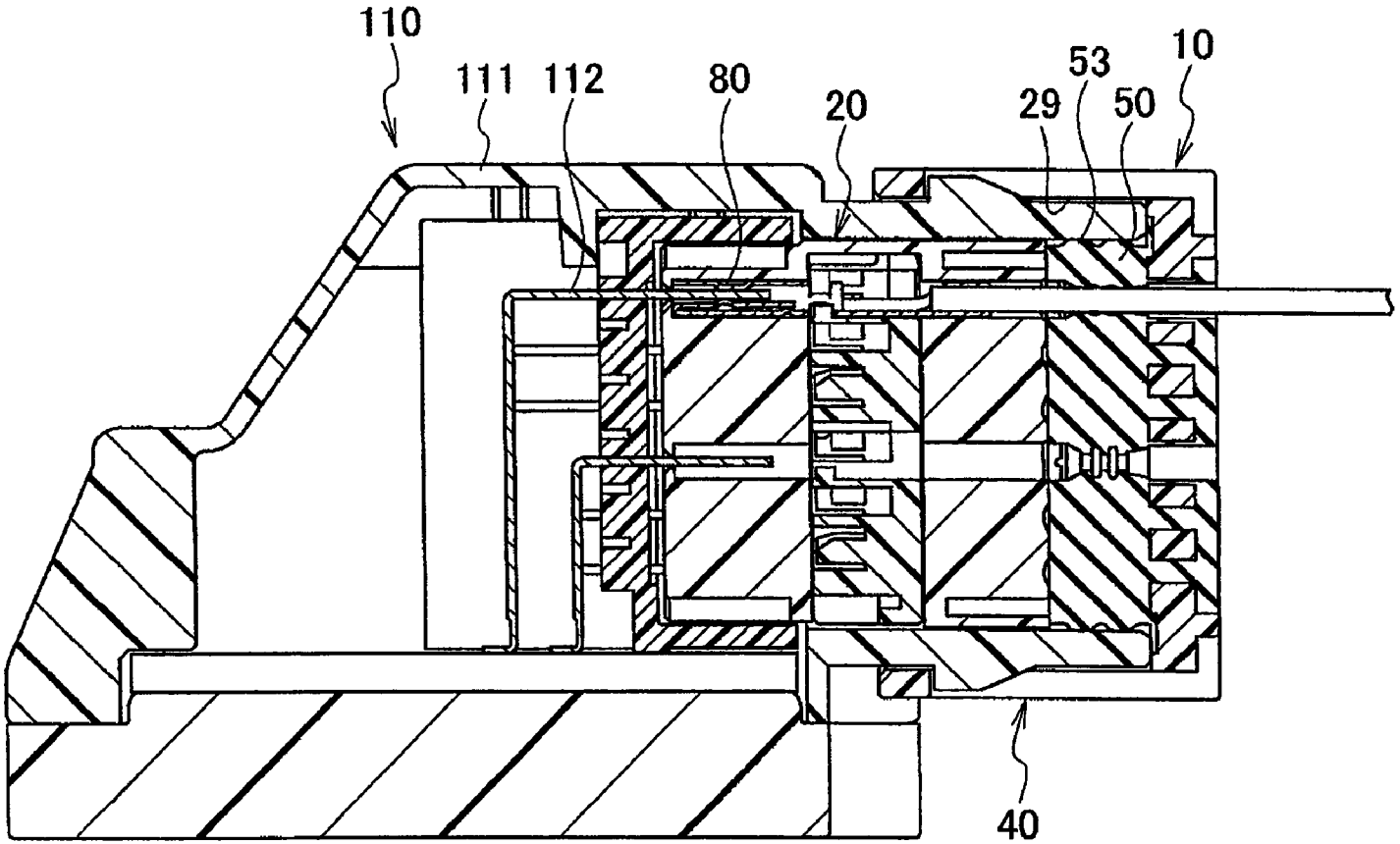
FIG. 22 is a side sectional view showing a state that the connector of the exemplary embodiment of the present invention is fitted to a mate side connector.

Further, FIG. 19 is a perspective view of an external appearance of the connector of the exemplary embodiment of the present invention seen from a front side when an assembling operation is completed. FIG. 20 is a front view of the connector seen from the front side. FIG. 21 is a sectional view taken along a line B-B in FIG. 20. FIG. 22 is a side sectional view showing a state that the connector of the exemplary embodiment is fitted to a mate side connector.

The connector 10 includes a connector housing 10A shown in FIGS. 1 to 5 and a plurality of round terminals 80 shown in FIG. 12. The connector housing 10A is formed by combining an inner housing 20, an outer housing 40 and a spacer (refer it also to as a retainer) 60 which are all made of a synthetic resin.

In the connector housing 10A, many terminal insert holes 25, 61 and 45 extending forward and rearward are transversely and vertically arranged and the round terminals 80 as terminals are respectively inserted into the terminal insert holes 25, 61 and 45 of the connector housing 10A from rear parts.

In the terminal insert holes 25, 61 and 45 of the connector housing 10A respectively, flexible lances (flexible engaging arms) 62 are provided to prevent the round terminals 80 from slipping out rearward when the round terminals 80 are inserted into the terminal insert holes 25, 61 and 45 from the rear parts. As described below, the lances 62 are provided in the terminal insert holes 61 of the spacer 60. As shown in FIG. 6, the lance is arranged at a position in an oblique direction relative to a vertical direction and a transverse direction seen from a central part of each terminal insert hole 61. Further, as shown in FIG. 7, a bending direction Y5 of each lance 62 is set to a direction substantially corresponding to the above-described oblique direction.

Further, in the connector housing 10A, when the arrangements of the terminal insert holes 25, 61 and 45 in the transverse direction are referred to as "lines" the terminal insert holes 25, 61 and 45 are arranged with pitches between the lines in the vertical direction set to be constant. In the lines in the vertical direction respectively, the terminal insert holes 25, 61 and 45 are linearly arranged with prescribed pitches P in the transverse direction. Further, between the lines adjacent in the vertical direction, the positions of the terminal insert holes 25, 61 and 45 are respectively shifted by 1/integer times as long as the arrangement pitch P (a pitch Pa ⅓ times as long as the pitch P in the exemplary embodiment) in the transverse direction.

Now, parts are respectively described below.

The inner housing 20 is a rectangular block shaped member and has in rear end parts four connecting arms 21 to be connected to the outer housing 40. The connecting arms 21 respectively have engaging pawls 22 at their ends. In the inner housing 20, many terminal insert holes 25 composed of circular holes are formed. Ends of the terminal insert holes 25 are respectively opened on a front end wall of the inner housing 20 as introducing holes 25*a* (see FIG. 13) of a mate side male terminals.

Further, in the inner housing 20, a spacer insert recessed part 24 is formed from its lower surface (an outer peripheral surface) to an inner part. The spacer 60 can be inserted into the spacer insert recessed part 24 from a lower part to an upper part as shown by an arrow mark Y1 (see FIG. 1) intersecting an inserting direction Y4 (see FIG. 4) of the round terminal 80. In the spacer insert recessed part 24, as shown in FIG. 13 and FIG. 14, are provided a temporary engagement receiving part 27 with which a temporarily engaging unit 67 of the spacer 60 is engaged and a main engagement receiving part 26 with which a mainly engaging unit 68 of the spacer 60 is engaged.

A rear end outer peripheral part 28 of the inner housing 20 is set to such a dimension of an outer form as to ensure an annular space 29 for receiving a fitting tubular wall of a mate connector 110 between an inner peripheral wall 48 of a rectangular tubular periphery wall 41 of the outer housing 40 and the rear end outer peripheral part 28 when the inner housing 20 is attached to the outer housing 40.

On the other hand, as shown in FIG. 1, in the outer housing 40, a rear end opening of the rectangular tubular periphery wall 41 having a front end opened is closed by a rear end wall 42 so that a rear half part of the inner housing 20 may be accommodated in an inner void 43. In the rear end wall 42 of the outer housing 40, the terminal inset holes 45 are formed correspondingly to the terminal insert holes 25 of the inner housing 20. Further, as shown in FIG. 3, FIG. 13 and FIG. 14, connecting holes 46 are provided into which the connecting arms 21 of the inner housing 20 are inserted. In the connecting holes 46, engaging protrusions 47 are formed with which the engaging pawls 22 of the connecting arms 21 are engaged.

Further, in a front surface (an inner surface) of the rear end wall 42 of the outer housing 40, a main body part 51 of a thick plate shaped mat seal 50 is arranged. The mat seal 50 is made of flexible rubber and is formed integrally with the outer housing 40 by a two-color molding or an insert molding.

The main body part 51 of the mat seal 50 having a seal lip 53 in an outer peripheral part is connected to a rear surface plate part 52 of a rear surface (an outer surface) of the rear end wall 42 through the terminal insert holes 45 and formed integrally therewith. In the mat seal 50, insert holes (unified by reference numerals 45) corresponding to the terminal insert holes 45 are formed. In an inner periphery of the insert hole, an inner periphery seal lip (reference numeral is omitted) that seals a part between an electric wire and the outer housing 40 is provided in close contact with an outer periphery of a coat of the electric wire W (FIG. 21) extending rearward of the round terminal 80.

Further, in the mat seal 50, as shown in FIG. 3, a seal hole 56 is provided for sealing a part between the connecting arm 21 and the outer housing 40 when the connecting arm 21 of the inner housing 20 is inserted into the connecting hole 46 of the outer housing 40.

Now, referring to FIGS. 6 to 11 and FIG. 13 and FIG. 14, the spacer 60 will be described below.

The spacer 60 is a thick plate shaped member having such a thickness as to be just inserted into the spacer insert recessed part 24 of the inner housing 20. Here, a primarily engaged (temporarily engaged) position (see FIG. 13) is set to a lower position in which an insertion of the spacer 60 is shallow relative to the spacer insert recessed part 24 and a secondarily engaged (mainly engaged) position (see FIG. 14) is set to an upper position in which the insertion is deep. Accordingly, during the primary engagement shown in FIG. 13, a space S1 where the spacer 60 can be more pushed is ensured in an interior of the spacer insert recessed part 24.

In the spacer 60, as shown in FIG. 13 and FIG. 14, are provided the temporarily engaging unit 67 that is engaged with the temporary engagement receiving part 27 of the inner housing 20 side to temporarily engage the spacer 60 in the temporarily engaged position and the mainly engaging unit 68 that is engaged with the main engagement receiving part 26 of the inner housing 20 side to mainly engage the spacer 60 in the mainly engaged position.

Further, the spacer 60 has many terminal insert holes 61 corresponding to the terminal insert holes 25 and 45 of the inner housing 20 or the outer housing 40. The terminal insert holes 61 are arranged as described above. In this case, the terminal insert holes 61 of the spacer 60 are formed in elliptical shapes long in the vertical direction.

In each of the terminal insert holes 61, a lance 62 as a temporarily terminal engaging unit is provided. The lance 62 is located in an obliquely upper position relative to the vertical direction and the transverse direction seen from the central part of each terminal insert hole 61. In this exemplary embodiment, the lance 62 is arranged at the obliquely upper position of a right part seen from a front surface of the connector. A bending direction Y5 (FIG. 7) is set to the direction substantially corresponding to the oblique direction.

When the spacer 60 is located in the temporarily engaged position, the lance 62 is bent outward so as to permit the round terminal 80 to be inserted into the terminal insert hole 61. When the round terminal 80 is inserted to a prescribed position, the lance is returned from its bent state to engage an engaging edge part 62*a* provided as an edge part orthogonal to the bending direction with an engaging recessed part 83 of the round terminal 80 so that the round terminal 80 may be prevented (temporarily engaged) from slipping out rearward.

Further, in an inner bottom part of the terminal insert hole 61 of the spacer 60, an engaging protrusion part 63 is provided as a mainly terminal engaging unit that allows an engaging edge part 63*a* to be engaged with the engaging recessed part 83 of the round terminal 80 and assuredly prevents (mainly engages) the round terminal 80 from moving forward and backward when the spacer 60 is pressed to a mainly engaged position from the temporarily engaged position. The engaging edge part 63*a* of the engaging protrusion part 63 is provided as an edge part substantially parallel to the transverse direction. Thus, between the engaging edge part 63*a* of the engaging protrusion part 63 and the engaging edge part 62*a* of the lance 62, an angle θ (FIG. 7) larger than 0° and smaller than 90° is ensured.

Further, as shown in FIG. 12, the round terminal 80 includes a cylindrical box part 81 that receives a male terminal 112 of the mate connector 110. In the box part 81, a spring piece 82 is provided. In a rear side of the box part 81 of the round terminal 80, an engaging part 85 is provided that is engaged with the lance 62 and the engaging protrusion part 63 and positions the round terminal 80 in the rotating direction during the engaging process. In a further rear side of the engaging part 85, an electric wire connecting part (an electric conductor caulking part 87 and a coat caulking part 88) to which a terminal of a coated electric wire is connected.

The engaging part 85 includes the engaging recessed part 83 formed by recessing two opposed surfaces of a cylindrical periphery wall forming the box part 81 and a rotating direction position control part 84 formed by the cylindrical periphery wall remaining at a position where the engaging recessed part 83 is formed.

The engaging recessed part 83 is provided for allowing the engaging edge part 62*a* of the lance 62 and the engaging edge part 63*a* of the engaging protrusion part 63 of the spacer 60 to be fitted to the engaging recessed part so that the round terminal 80 is prevented from moving forward and backward. A bottom surface of the engaging recessed part 83 serves as the positioning surface 83*a*.

Further, the rotating direction position control part 84 is provided for applying a rotation for controlling a position in the rotating direction to the round terminal 80 by a rotation moment generated by a contact pressure when the engaging edge part 62*a* of the lance 62 and the engaging edge part 63*a* of the engaging protrusion part 63 of the spacer 60 are pressed to come into contact therewith. A circular arc surface formed on an outer peripheral surface of the cylindrical periphery wall of the box part 81 serves as an abutting surface 84*a*.

In this case, the engaging part 85 has a substantially rectangular shape in section and to which direction the rotation moment is applied is determined in accordance with a positional relation between an abutting position when the engaging edge part 63*a* of the engaging protrusion part 63 abuts on a corner part of the engaging part and a center of a section of the round terminal 80. At that time, when the lance 62 is properly temporarily engaged with the round terminal 80, it is determined whether or not the rotation moment is assuredly applied by a dimension of a short side of the engaging part 85 having the substantially rectangular shape in section, a radius to the a butting surface 84*a* from the center of the section of the round terminal 80 to the abutting surface 84*a* and the angle θ formed by the engaging edge part 62*a* of the lance 62 and the engaging edge part 63*a* of the engaging protrusion part 63.

Thus, in order to assuredly apply the rotation moment, the angle θ formed by the engaging edge part 63*a* of the engaging protrusion part 63 and the engaging edge part 62*a* of the lance 62 is set to a range of 30° to 60° as shown in FIG. 11. FIG. 11(*a*) shows a case that θ is θ1 (30°), FIG. 11(*b*) shows a case that θ is θ2 (45°) and FIG. 11(*c*) shows a case that θ is θ3 (60°). In all the cases, the rotation moment can be assuredly applied.

Now, a procedure of an assembling operation will be described below.

When the connector 10 is assembled, as shown by the arrow mark Y1 in FIG. 1, initially, the spacer 60 is inserted into the spacer insert recessed part 24 of the inner housing 20 from a lower part to primarily engage (temporarily engage) the spacer 60 with the inner housing 20 (a state shown in FIG. 13).

Then, the inner housing 20 is attached to the outer housing 40 as shown by an arrow mark Y2 in FIG. 1 and an arrow mark Y3 in FIG. 4 to connect the inner housing 20 to the outer housing 40 by the connecting arms 21.

Then, under this state, since the connector housing 10A in a temporarily engaged state is formed, the round terminal 80 is inserted from a rear part of the outer housing 40 as shown by an arrow mark Y4 in FIG. 4.

When the round terminal 80 is inserted until the engaging part 85 of the round terminal 80 reaches the lance 62, as shown in FIG. 15 and FIG. 16, the round terminal 80 is primarily engaged with the lance 62. At this time, as shown in FIG. 17(*a*), even when the round terminal 80 is inserted in any orientation, the rotation moment for correcting the position is applied to the round terminal 80 due to a pressure contact between the abutting surface 84*a* of the rotating direction position control part 84 of the engaging part 85 and the engaging edge part 62*a* of the lance 62. Thus, as shown in FIG. 17(*b*), the engaging recessed part 83 faces the lance 62 in a proper position, the positioning surface 83*a* of the engaging recessed part 83 is located to be parallel to the engaging edge part 62*a* of the lance 62 in a stable state and the engaging edge part 62*a* of the lance 62 is fitted to the engaging recessed part 83 so that the round terminal 80 is primarily engaged (temporarily engaged).

When all the round terminals 80 are inserted, the spacer 60 is more pushed in upward to secondarily engage (mainly engage) the spacer 60 with the inner housing 20 (a state shown in FIG. 14). Thus, during a process of raising the spacer 60, as shown in FIG. 18(*b*), the lance 62 is separated from the engaging part 85 of the round terminal 80 and the engaging edge part 63*a* of the engaging protrusion part 63 is pressed to come into contact with the corner part of the abutting surface 84*a* of the rotating direction position control part 84 of the round terminal 80. Thus, the rotation moment is generated by the contact pressure F1 and the abutting position.

Thus, the round terminal 80 is rotated in a direction shown by an arrow mark R1, and finally, the engaging edge part 63*a* of the engaging protrusion part 63 is more raised so that the engaging edge part 63*a* of the engaging protrusion part 63 abuts on the positioning surface 83*a* as the bottom surface of the engaging recessed part 83 as shown in FIG. 18(*c*) to determine the position of the round terminal 80 in the rotating direction. Further, since the engaging edge part 63*a* of the engaging protrusion part 63 is fitted to the engaging recessed part 83, the round terminal 80 is secondarily engaged (mainly engaged). At this time, the spacer 60 is mainly engaged with the inner housing 20. Thus, the assembly of the connector 10 as shown in FIGS. 19 to 21 is completed.

After the connector 10 is assembled, as shown in FIG. 22, when the connector 10 is fitted to the mate connector 110, an end of a fitting wall part of a mate connector housing 111 enters the annular space 29 between the inner housing 20 and the outer housing 40 of the connector 10 of the exemplary embodiment and the fitting wall part comes into close contact with the seal lip 53 of the mat seal 50 to seal a fitting part of the inner housing 20 and the mate connector housing 111. Further, the male terminal 112 of the mate connector 110 is introduced into the box part 81 of the round terminal 80 held in the inner housing 20 from an insert hole of the front end of the inner housing 20 to connect both the connectors to each other.

As described above, according to the connector 10 of the present exemplary embodiment, since the lance 62 is arranged at the position in the oblique direction relative to the vertical direction and the transverse direction (the directions in which the terminal insert holes are arranged) seen from the central part of each of the terminal insert holes 25, 45 and 61 and the bending direction of the lance 62 is set to the direction substantially corresponding to the oblique direction, the blank spaces between the plurality of terminal insert holes 25, 45 and 61 are effectively used so that the lances 62 may be arranged or the bending spaces of the lances 62 may be ensured. Accordingly, the round terminals 80 can be densely arranged, which can contribute to the miniaturization or the multi-polar form of the connector 10.

Further, since the positions of the terminal insert holes 25, 45 and 61 in the transverse direction are shifted between the adjacent upper and lower lines, the blank spaces between the terminal insert holes 25, 45 and 61 are effectively used and many terminal insert holes 25, 45 and 61 can be densely arranged in the vertical direction. Accordingly, the round terminals 80 can be more densely arranged, so that the connector can be more miniaturized or the connector can have a more multi-polar form. Further, since an amount of shift of the terminal insert holes 25, 45 and 61 in the transverse direction between the adjacent upper and lower lines is set to ⅓ times as long as the pitch P of the terminals in the transverse direction, the positions of the terminal insert holes 25, 45 and 61 can be allowed to mutually correspond in the transverse direction at intervals of two lines in the vertical direction. Accordingly, a prescribed regularity can be provided irrespective of a zigzag arrangement.

Further, according to the connector 10 of the present exemplary embodiment, since the spacer 60 that is mainly engaged with the inserted round terminal 80 is provided integrally with the lances 62 as the temporarily terminal engaging units, under a state that the individual round terminals 80 are respectively temporarily engaged with the lances 62, the spacer 60 is inserted to the mainly engaged position, so that all the round terminals 80 can be mainly engaged with the engaging protrusion parts 63 (the mainly terminal engaging parts) provided in the spacer 60 at the same time. Accordingly, the assembly workability is improved and the round terminals 80 can be assuredly fixed.

Further, when the spacer 60 is inserted upward into the spacer insert recessed part 24 of the inner housing 20 from the lower part, the spacer 60 can be positioned at the temporarily engaged position. When the spacer 60 is more pushed in to an interior part, the spacer 60 can be positioned at the mainly engaged position. At that time, under a state that the spacer 60 is located in the temporarily engaged position, the round terminal 80 can be inserted into the terminal insert hole 61 by bending the lance 62. Further, under a state that the lance 62 is temporarily engaged with the round terminal 80, when the spacer 60 is more pushed in to the inner mainly engaged position, the engaging protrusion part 63 provided in the spacer 60 is mainly engaged with the round terminal 80. Thus, the round terminal 80 can be assuredly prevented from slipping out and fixed.

Since the engaging edge part 63*a* of the engaging protrusion part 63 provided as the mainly terminal engaging part is formed as an edge part substantially parallel to the transverse direction and the engaging edge part 62*a* of the lance 62 provided at the obliquely upper position of the terminal insert hole 61 of the spacer 60 is provided as an edge part orthogonal to the bending direction of the lance 62, an angle larger than 0° and smaller than 90° can be provided between the engaging edge part 63*a* of the engaging protrusion part 63 and the engaging edge part 62*a* of the lance 62, and the engaging edge parts 62*a* and 63*a* can be employed for controlling the position of the round terminal 80 in the rotating direction.

Especially, in the connector 10, since the round terminal 80 is used as the terminal, the engaging edge part 63*a* of the engaging protrusion part 63 and the engaging edge part 62*a* of the lance 62 of the spacer 60 are fitted to the engaging recessed part 83 of the round terminal 80, and further, the engaging edge part 63*a* of the engaging protrusion part 63 and the engaging edge part 62*a* of the lance 62 of the spacer 60 are pressed to come into contact with the rotating direction position control part 84 of the round terminal 80, the position in the rotating direction of the round terminal 80 which is inserted without caring about the orientation during the temporary engagement of the lance 62 can be corrected to a position suitable for the lance 62. When the spacer 60 is pushed in to the mainly engaged position during a shift from the temporarily engaged state to the mainly engaged state, the round terminal 80 can be corrected to a proper engaged position by the pushing operation of the spacer 60. Thus, even when the round terminal 80 is used, the round terminal can be automatically positioned to a proper position and assembled in a final assembly stage.

Further, in the connector 10, since an angle θ formed by the engaging edge part 63*a* of the engaging protrusion part 63 and the engaging edge part 62*a* of the lance 62 is set to a range of 30° to 60°, even when the round terminal 80 is inserted in any direction, the direction of the round terminal 80 can be finally corrected to a proper direction to mainly engage the round terminal.

In the above-described exemplary embodiment, the lance 62 is provided in the spacer 60, however, the lance may be directly provided in the inner housing 20.

Further, in the above-described embodiment, the connector housing is formed by the outer housing 40 and the inner housing 20, however, a connector housing may be used that is entirely formed integrally with an outer housing and an inner housing.

In the above-described exemplary embodiment, the positions of the terminal insert holes are shifted by ⅓ times as long as the arrangement pitch of the terminals in the transverse direction so that the blank spaces between the terminal insert holes may be most effectively used in the adjacent lines. However, it is to be under stood that the above-described exemplary embodiment may be applied to a case that the positions of terminal insert holes are not shifted between lines arranged in the vertical direction and the terminal insert holes are respectively linearly arranged in the vertical direction (namely, the terminal insert holes are sequentially arranged).

What is claimed is:

1. A connector, including:

a connector housing having many terminal insert holes extending forward and backward which are arranged in the vertical direction and in the transverse direction; and a plurality of terminals respectively inserted into the terminal insert holes of the connector housing from a rear part, flexible lances being provided respectively in the terminal insert holes of the connector housing to prevent the terminals from slipping out rearward when the terminals are inserted into the terminal insert holes from the rear part, wherein the lance is arranged at a position in an oblique direction relative to the vertical direction and the transverse direction seen from a central part of each of the terminal insert holes and a bending direction of the lance is set to a direction substantially corresponding to the oblique direction.

2. The connector according to claim 1, wherein when the arrangement of the terminal insert holes in the transverse direction is referred to as a line, the terminal insert holes are arranged with pitches fixed between the lines in the vertical direction and linearly arranged with the fixed pitches in the transverse direction in each of the lines in the vertical direction, and between the adjacent lines in the vertical direction, positions of the terminal insert holes are shifted by 1/integer times as long as the arrangement pitch in the transverse direction.

3. The connector according to claim 1, wherein the connector housing includes a spacer insert recessed part formed from an outer peripheral surface of the connector housing to an inner part and a spacer that can be inserted into the spacer insert recessed part in a direction intersecting an inserting direction of the terminal, has a temporarily engaging unit which is temporarily engaged with the connector housing under an inserted state and a mainly engaging unit which is mainly engaged with the connector housing, has terminal insert holes corresponding to the terminal insert holes of the connector housing and has a mainly terminal engaging part which permits the terminal to be inserted into the terminal insert hole at a temporarily engaged position and is mainly engaged with the terminal at a mainly engaged position to prevent the terminal from moving forward and backward, and, in the spacer, the lance is integrally provided as a temporarily terminal engaging unit that is temporarily engaged with the terminal when the terminal is inserted into the terminal insert hole from the rear part under a state that the spacer is located at the temporarily engaged position.

4. The connector according to claim 3, wherein an inserting direction of the spacer to the spacer insert recessed part is set to a direction extending upward from a lower surface of the connector housing, the temporarily engaged position is set to a lower position where the insertion of the spacer to the spacer insert recessed part is shallow and the mainly engaged position is set to an upper position where an insertion to the spacer insert recessed part is deep, the mainly terminal engaging part is provided, in an inner bottom part of the terminal insert hole of the spacer, as an engaging protrusion part fitted to an engaging recessed part of the terminal side, an engaging edge part of the engaging protrusion part is provided as an edge part substantially parallel to the transverse direction, the lance is arranged at an obliquely upper position of the terminal insert hole of the spacer and an engaging edge part of the lance fitted to the engaging recessed part of the terminal side is provided as an edge part orthogonal to the bending direction of the lance.

5. The connector according to claim 4, wherein the terminal insert holes of the connector housing are formed as circular holes, the terminal is formed as a round terminal having a cylindrical box part for receiving a male terminal of a mate connector, in a rear part of the box part of the round terminal, an engaging part is provided that is engaged with the lance and the engaging protrusion part and positions a rotating direction of the round terminal during a process of engagement, in a further rear side, an electric wire connecting part is provided to which a terminal of a coated electric wire is connected, the engaging part includes an engaging recessed part formed by recessing two opposed surfaces of a cylindrical periphery wall forming the box part and a rotating direction position control part formed by the cylindrical periphery wall remaining at a position where the engaging recessed part is formed, the engaging recessed part is provided to which the engaging edge part of the lance and the engaging edge part of the engaging protrusion part of the spacer are fitted to prevent the terminal from moving forward and backward, and the rotating direction position control part is provided to apply a rotation for controlling a position in a rotating direction to the terminal by a rotation moment generated by a contact pressure when the engaging edge part of the lance and the engaging edge part of the engaging protrusion part of the spacer are pressed to come into contact therewith.

6. The connector according to claim 5, wherein an angle formed by the engaging edge part of the engaging protrusion part and the engaging edge part of the lance is set to a range of 30° to 60°.

* * * * *